US011406189B2

(12) United States Patent
Schlanger

(10) Patent No.: US 11,406,189 B2
(45) Date of Patent: Aug. 9, 2022

(54) FURNITURE ASSEMBLY SYSTEM

(71) Applicant: Raphael Schlanger, Wilton, CT (US)

(72) Inventor: Raphael Schlanger, Wilton, CT (US)

( * ) Notice: Subject to any disclaimer, the term of this patent is extended or adjusted under 35 U.S.C. 154(b) by 0 days.

(21) Appl. No.: 16/710,040

(22) Filed: Dec. 11, 2019

(65) Prior Publication Data

US 2020/0187651 A1 Jun. 18, 2020

Related U.S. Application Data

(60) Provisional application No. 62/780,287, filed on Dec. 16, 2018.

(51) Int. Cl.

| | |
|---|---|
| ***A47B 96/02*** | (2006.01) |
| ***A47B 47/00*** | (2006.01) |
| ***A47B 96/14*** | (2006.01) |

(52) U.S. Cl.

CPC ..... *A47B 96/02* (2013.01); *A47B 47/0058* (2013.01); *A47B 96/14* (2013.01); *A47B 47/0091* (2013.01); *A47B 2220/12* (2013.01)

(58) Field of Classification Search

CPC ..... A47B 96/02; A47B 47/0058; A47B 96/14; A47B 2220/12; A47B 47/0091

See application file for complete search history.

(56) References Cited

U.S. PATENT DOCUMENTS 1,480,939 A * 1/1924 Hand ..... G11B 33/0444 312/9.18
3,352,541 A 11/1967 Thom
3,355,132 A * 11/1967 Jenkins ..... H02G 3/0456 248/59
3,489,392 A * 1/1970 Thom ..... F16B 7/0413 256/65.08
3,606,023 A * 9/1971 Edmunds ..... A47B 73/006 211/74
3,739,921 A * 6/1973 Schmidt ..... F16B 7/00 211/194
3,879,906 A * 4/1975 Hollenberg ..... F16B 9/02 403/346
3,948,581 A * 4/1976 Helman ..... A47B 47/05 312/198
4,167,908 A * 9/1979 Jones ..... A47B 47/00 108/149
4,445,801 A * 5/1984 Trudeau ..... A63H 33/10 403/219
4,711,183 A * 12/1987 Handler ..... A47B 57/402 108/107
6,017,107 A * 1/2000 Elliott ..... A47B 47/04 108/181
6,786,337 B2 * 9/2004 Klein ..... A47F 5/01 211/134
8,876,145 B1 * 11/2014 Bernal ..... B62B 3/02 280/638

(Continued)

*Primary Examiner* — Ko H Chan

(57) ABSTRACT

A furniture assembly system including: a horizontal member; a vertical member arranged to cross said horizontal member as viewed in a plan view; a cross axis extending in an axial direction; a binding element to bind the horizontal member to the vertical member along the cross axis. The horizontal member crosses the vertical member at a crossover interface where the horizontal member is keyed to the vertical member at a keying interface adjacent the crossover interface to limit circumferential rotation therebetween about the cross axis.

29 Claims, 16 Drawing Sheets

(56) References Cited

U.S. PATENT DOCUMENTS

Figure 1A:
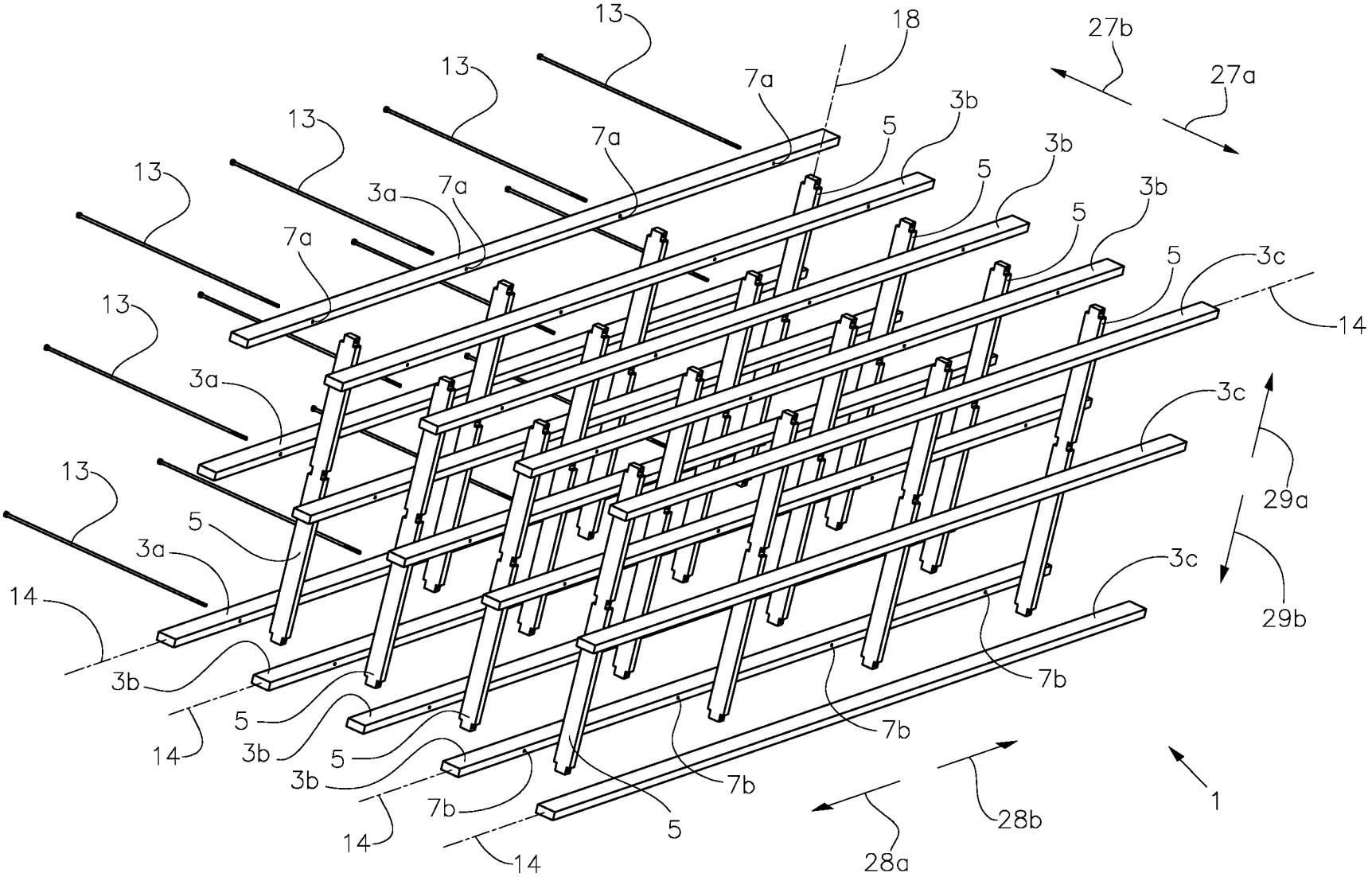

| | | | | |
|---|---|---|---|---|
| 10,143,298 | B2 * | 12/2018 | Wood | A47B 47/0091 |
| 2006/0162277 | A1 * | 7/2006 | Schultz | F16B 12/125 52/741.4 |

* cited by examiner

FURNITURE ASSEMBLY SYSTEM

CROSS-REFERENCE TO RELATED APPLICATION

This application claims priority of U.S. Provisional Patent Application 62/780,287, filed Dec. 16, 2018.

BACKGROUND OF THE INVENTION

(1) Field of the Invention

The present invention relates to the assembly and construction of furniture, more specifically a shelving unit consisting of an assembled lattice of vertical and horizontal members, wherein these vertical and horizontal members are engaged to each other for location purposes and/or to limit rotation therebetween about a crossover axis.

(2) Description of the Related Art

Prior-art shelving units that are designed to be shipped in knocked-down form and then field-assembled are commonly assembled from vertical members and horizontal elements. However, these assemblies can easily flex or pivot about an axial axis where these vertical and horizontal elements cross, allowing the shelving unit to rack or to "parallelogram". To prevent this racking, these shelving units commonly also include diagonal cross bracing and/or vertical panels that provide web bracing. This diagonal bracing and/or web bracing can impede access to the openings of the shelving unit. This bracing also serves to aesthetically close off the opening, detracting from the aesthetic appearance of the shelving unit.

Further, these vertical and horizontal elements commonly take the form of boards, which have a heavy and solid aesthetic and which shield light from entering the openings of the shelving unit.

Some other prior-art shelving units resort to welded or glued construction, which provides a robust connection between horizontal and vertical elements that may, in some cases, not require such bracing. However, this type of fabrication may not be field assembled by a layman and instead requires that the shelving unit be delivered in pre-assembled form. This pre-assembly is commonly much larger than a knock-down unit, resulting in excessively high delivery cost. The large shelving unit is also unwieldy and clumsy to maneuver prior to installation.

Accordingly, it is an objective of the present invention to overcome the forgoing disadvantages and provide an improved furniture assembly, particularly as applied to a shelving unit.

SUMMARY OF THE INVENTION

The present invention utilizes horizontal member(s) that are aligned to form a generally flat planar surface, and vertical member(s) that extend to cross and intersect with the horizontal member(s). The horizontal and vertical member (s) may be alternately staggered and interleaved in an axially stacked assembly to create a lattice shelving unit. The horizontal and vertical members are rotationally keyed to each other at (or adjacent) this intersection to prevent and/or limit rotation therebetween about a cross axis. The horizontal and vertical members are preferably bound to each other along the cross axis by a binding element to prevent their separation and to maintain this rotationally keyed engagement.

Preferably a plurality of horizontal members are utilized and are aligned to approximate a flat planar surface. This plurality of horizontal members is interleaved with a plurality of vertical members, resulting in a plurality of keyed engagements stacked along the cross axis. This plurality of keyed engagements serve to provide a robust means to limit and/or prevent rotation between horizontal and vertical members without requiring any diagonal or web bracing.

Furthermore, the horizontal and vertical members may be easily field assembled, where a binding element may be utilized to bind these members as described. This allows for easy and economical shipping and delivery of the shelving unit.

Still further, the stack of horizontal and vertical members may be designed to include a gap between adjacent horizontal and/or vertical members, so that the shelving unit is assembled as an open lattice. These gaps lend a light, open, and airy aesthetic to the shelving unit that is preferred over the closed aesthetic associated with prior art shelving units made of panel construction. These gaps also allow light to enter the openings of the shelving unit and to illuminate the contents therein.

Yet further, in comparison with solid panel construction of prior art shelving units, the open lattice construction of the present invention requires less actual shelving material, saving material cost to provide a more economical shelving unit. This construction also reduces the weight of the shelving unit, which further reduces shipping and delivery costs while also making the unit easier to maneuver during installation.

Further features of the present invention will become apparent from considering the drawings and ensuing description.

Figure 1B:
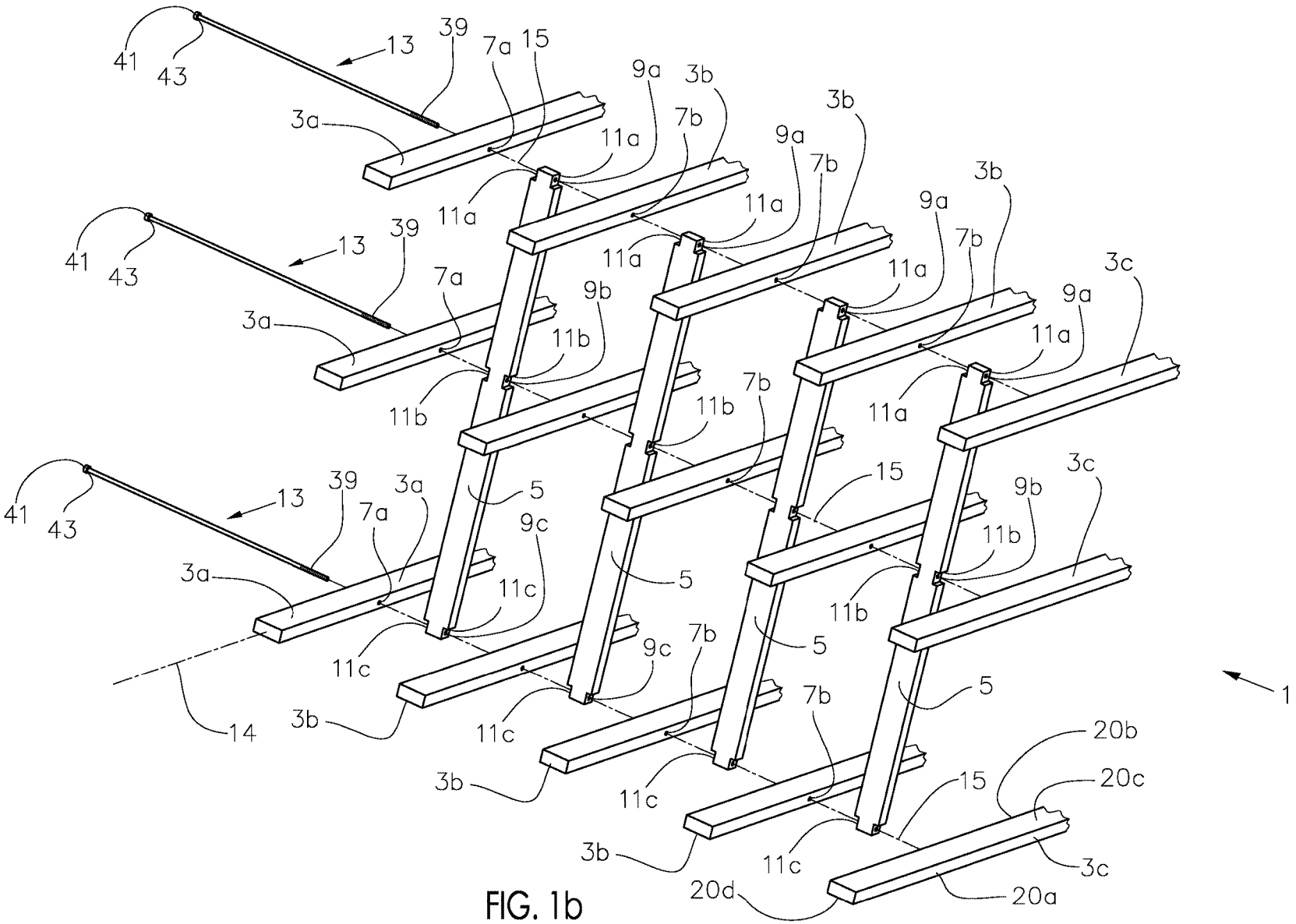

The present invention will be more readily understandable from a consideration of the accompanying exemplificative drawings, wherein:

FIG. 1*a* is an exploded perspective view of a first embodiment of the present invention, including a series of vertical members (rails), horizontal members (slats), and binding elements (binding screws), where the rails are notched to interlock with the adjoining slats;

FIG. 1*b* is an exploded perspective detail view of the embodiment of FIG. 1*a;*

Figure 1C:
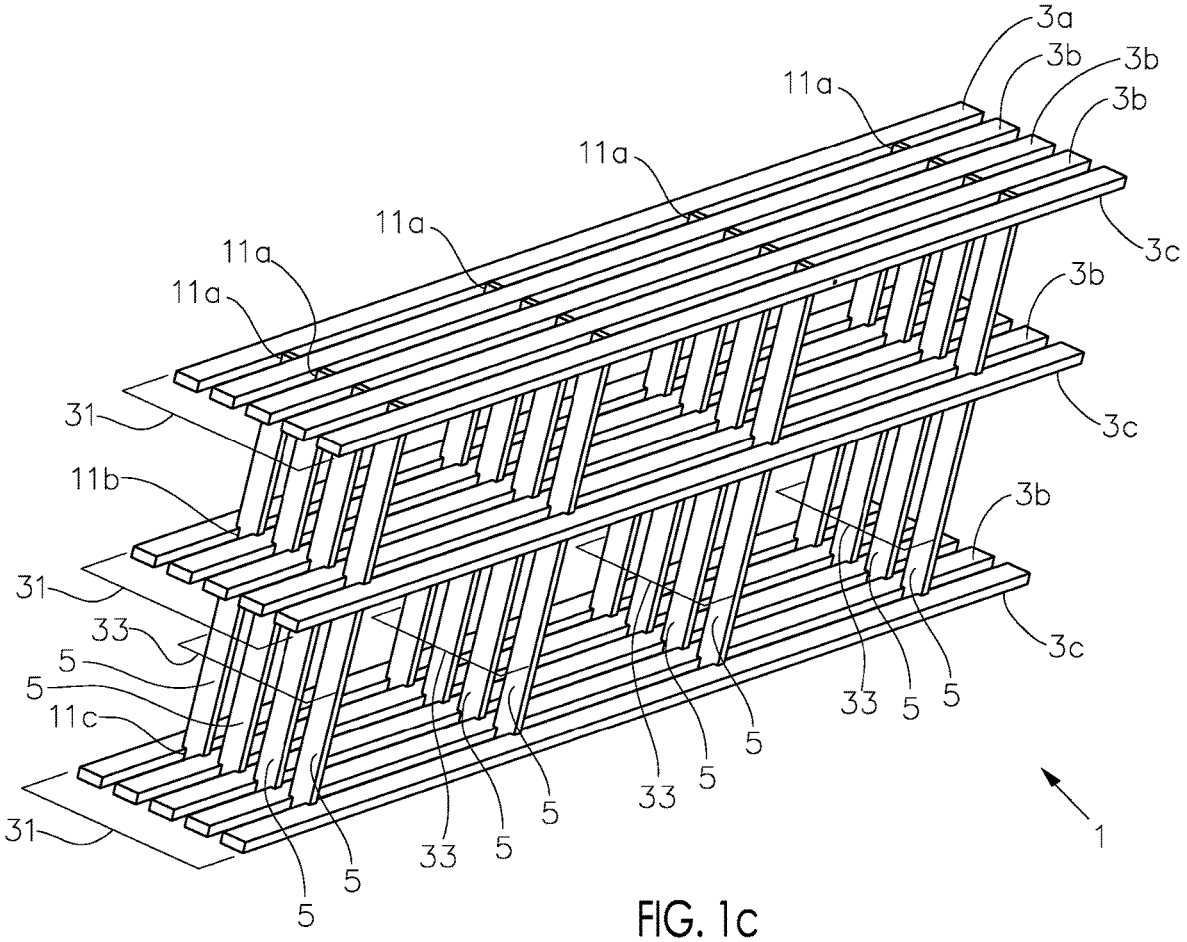
Figure 1D:
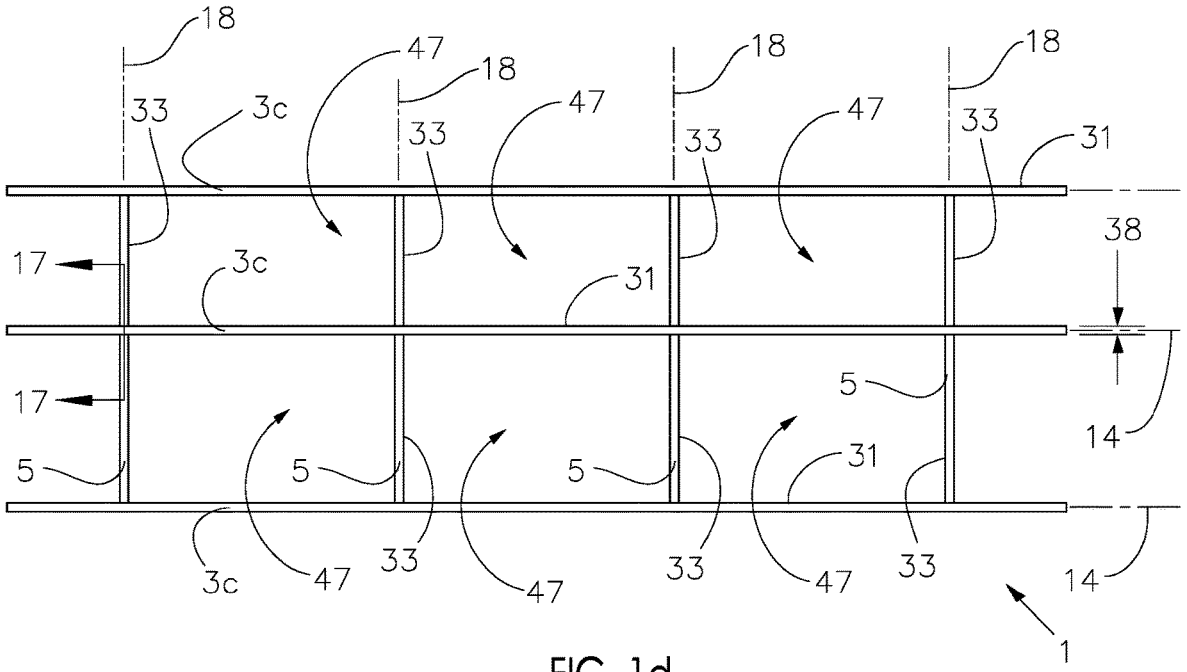
Figure 1E:
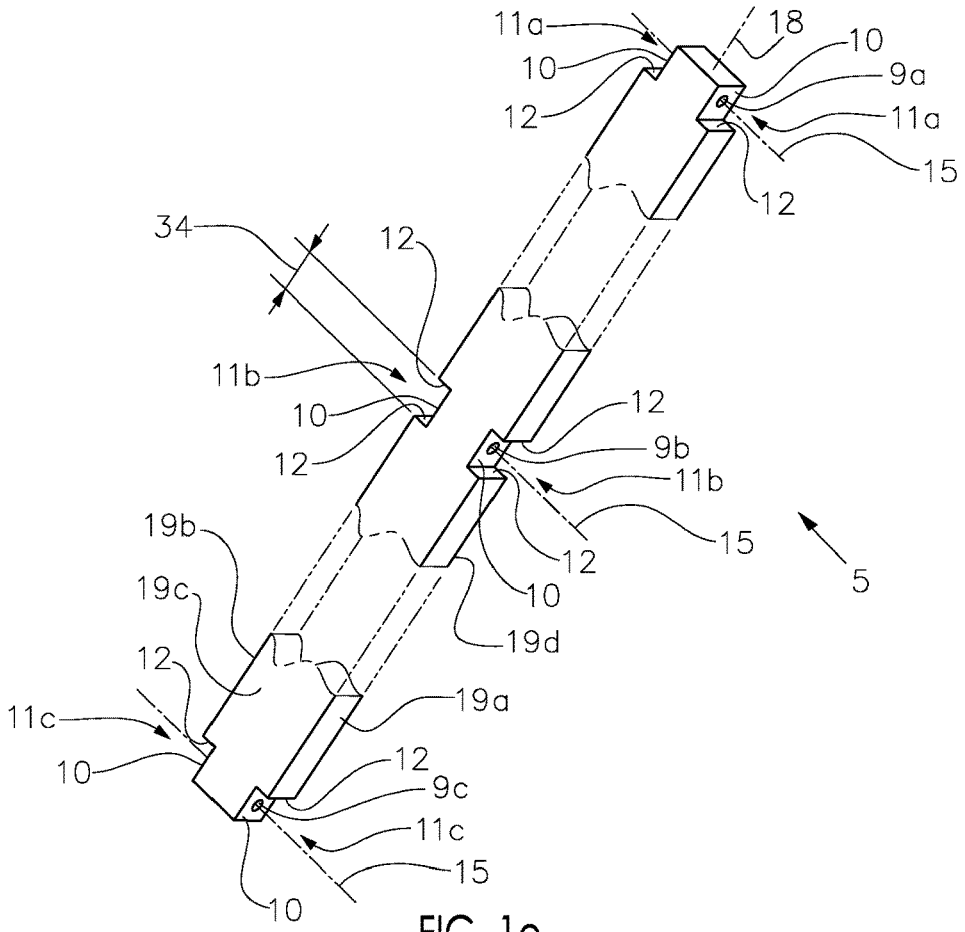

FIG. 1*c* is a perspective view of the embodiment of FIG. 1*a*, as assembled;

FIG. 1*d* is an orthogonal plan view of the embodiment of FIG. 1*a*, as assembled;

FIG. 1*e* is a broken perspective view of a rail of the embodiment of FIG. 1*a;*

Figure 1F:
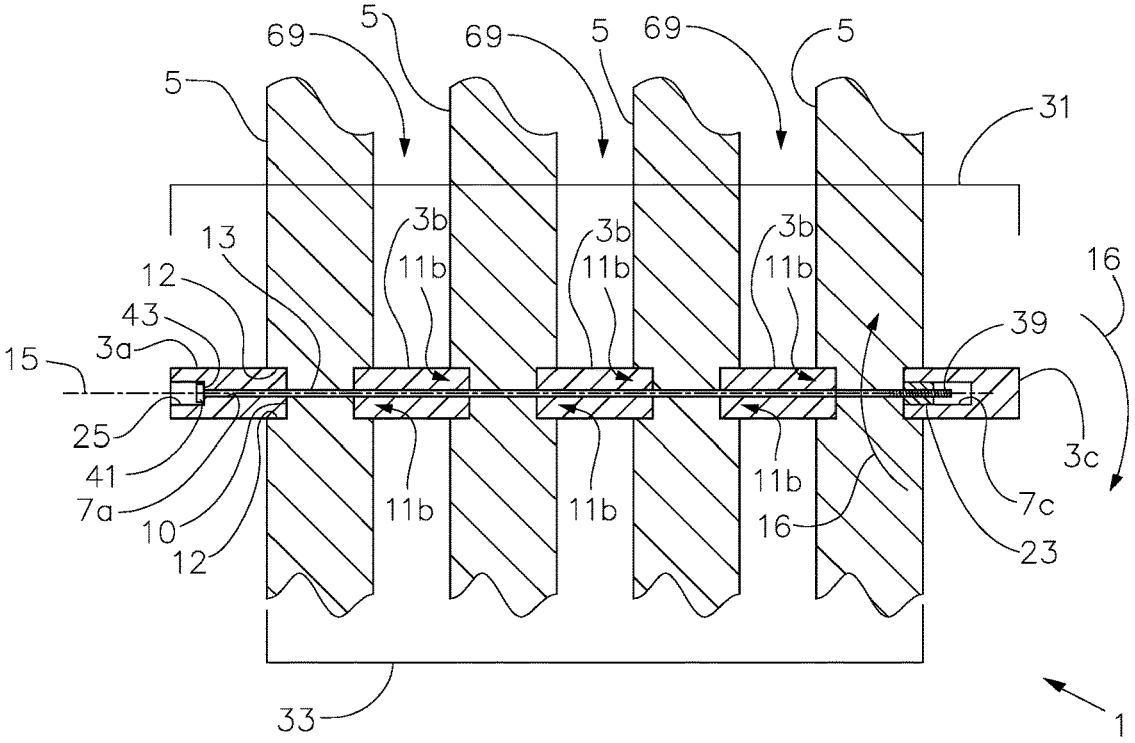
Figure 1G:
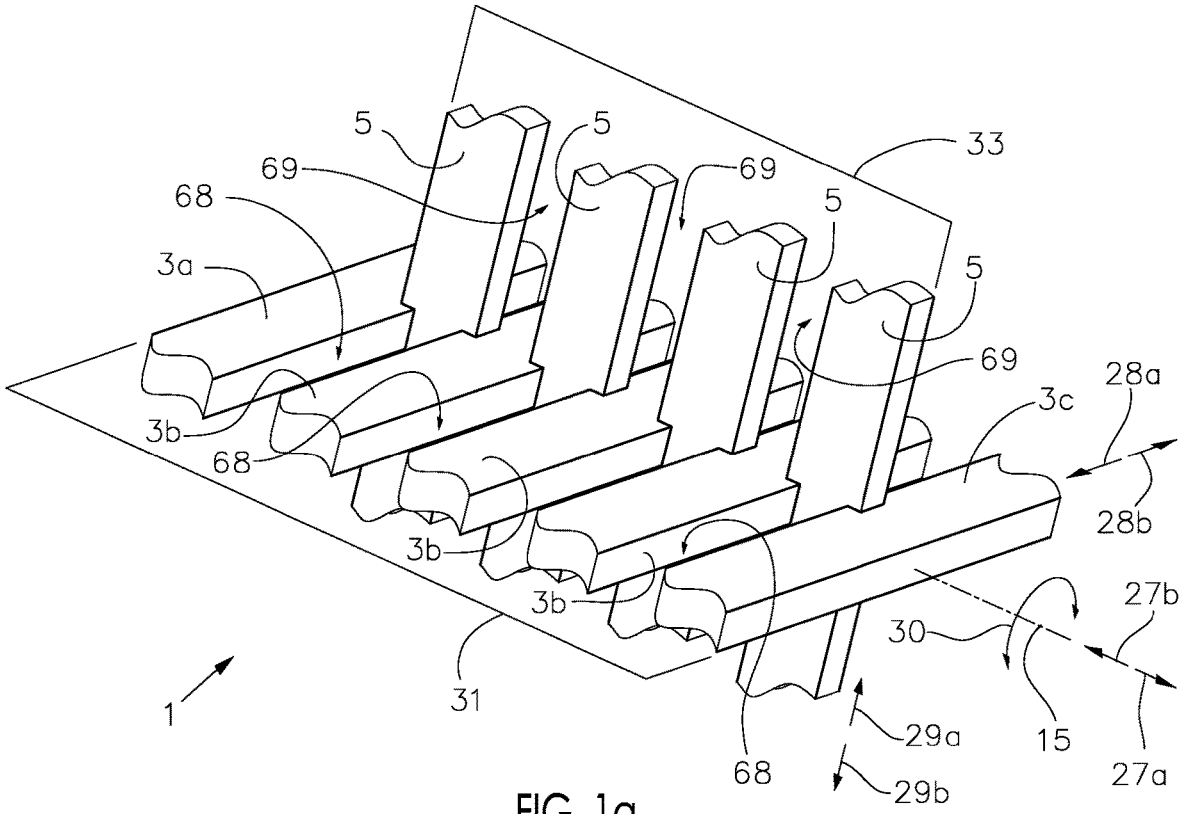
Figure 1H:
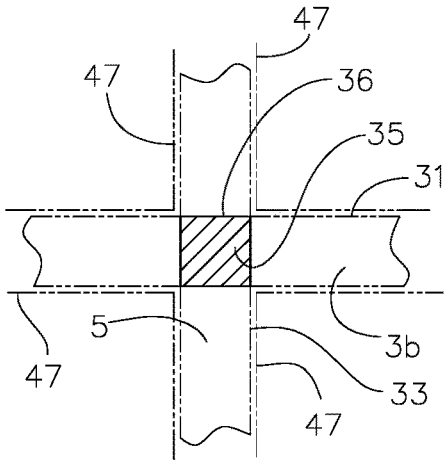
Figure 1I:
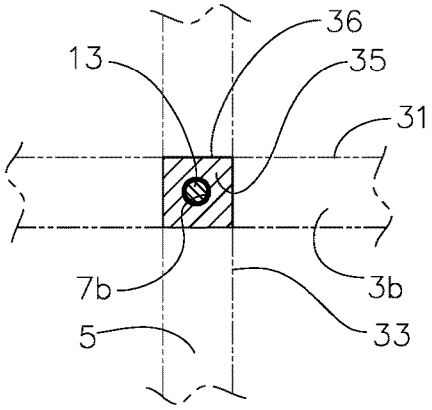
Figure 1J:
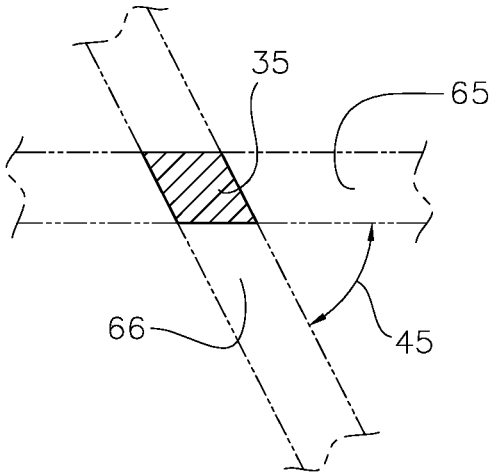
Figure 1K:
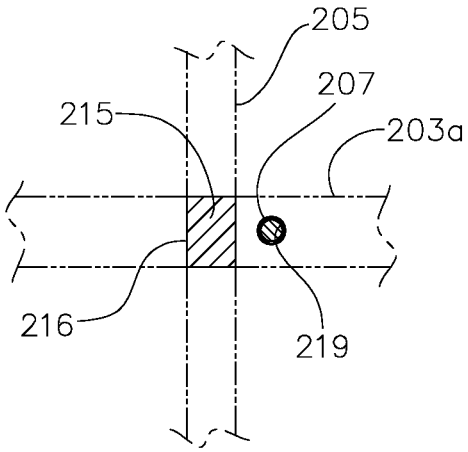
Figure 1L:
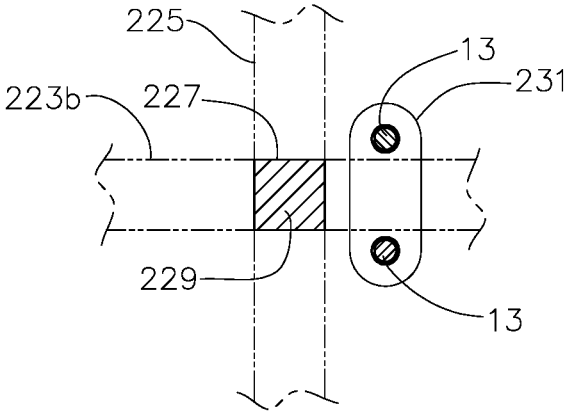
Figure 1M:
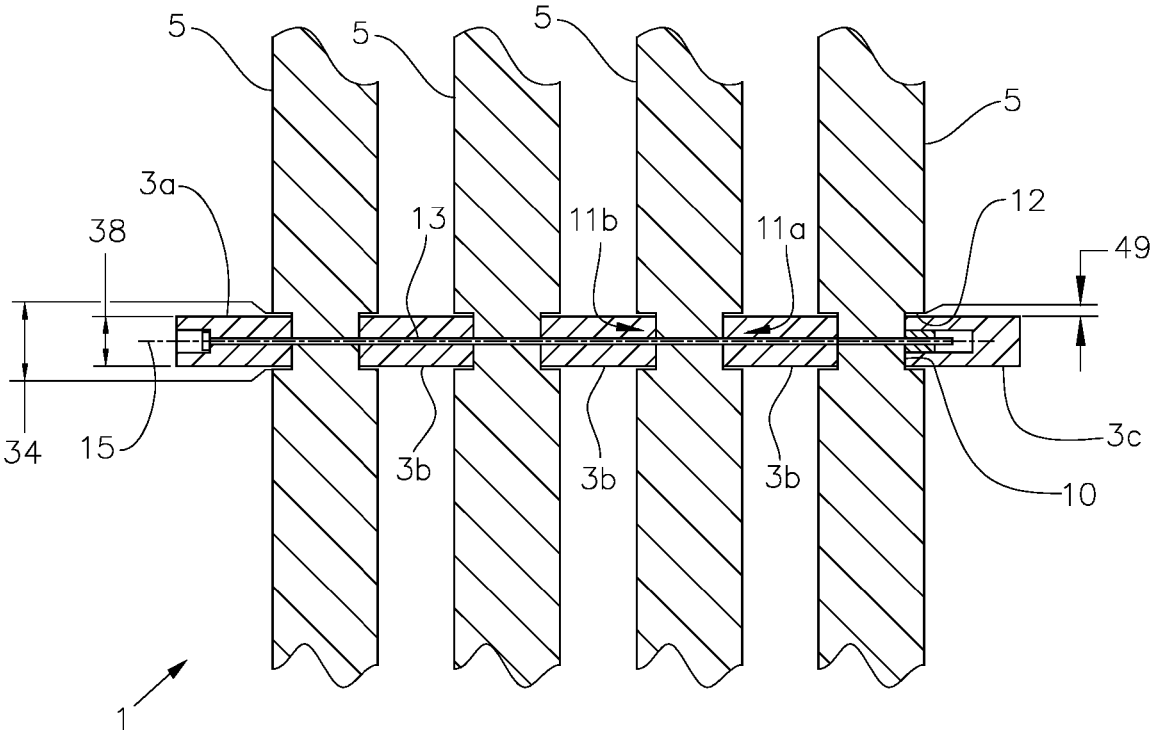
Figure 1N:
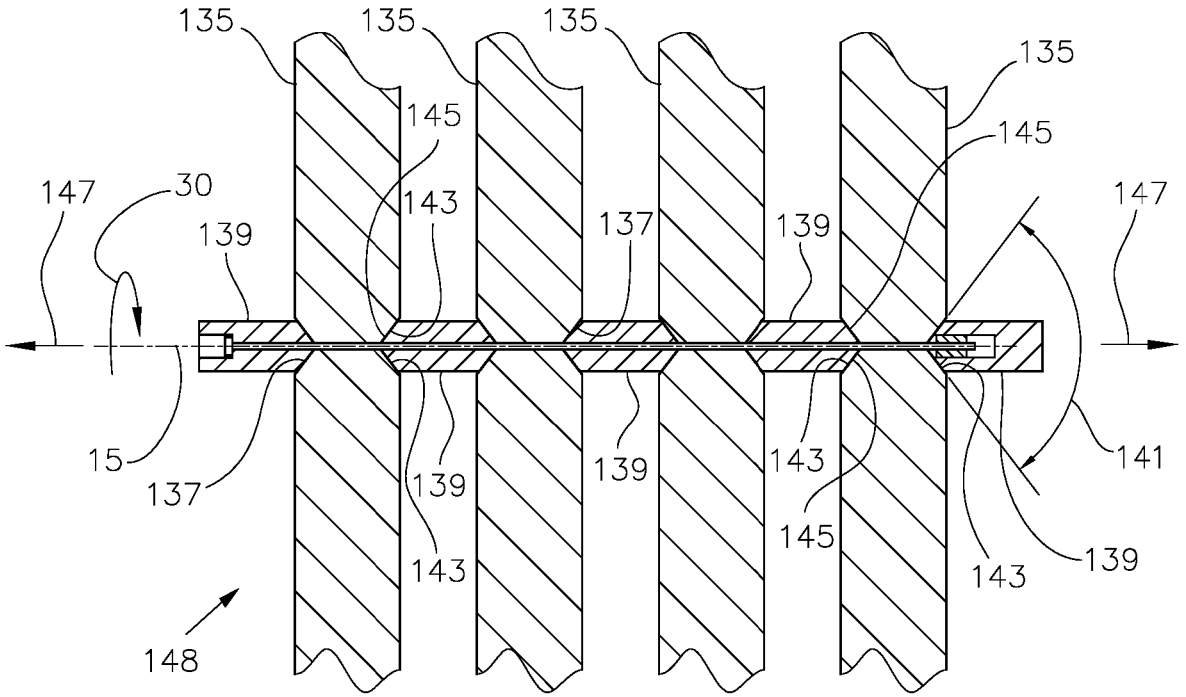
Figure 1P:
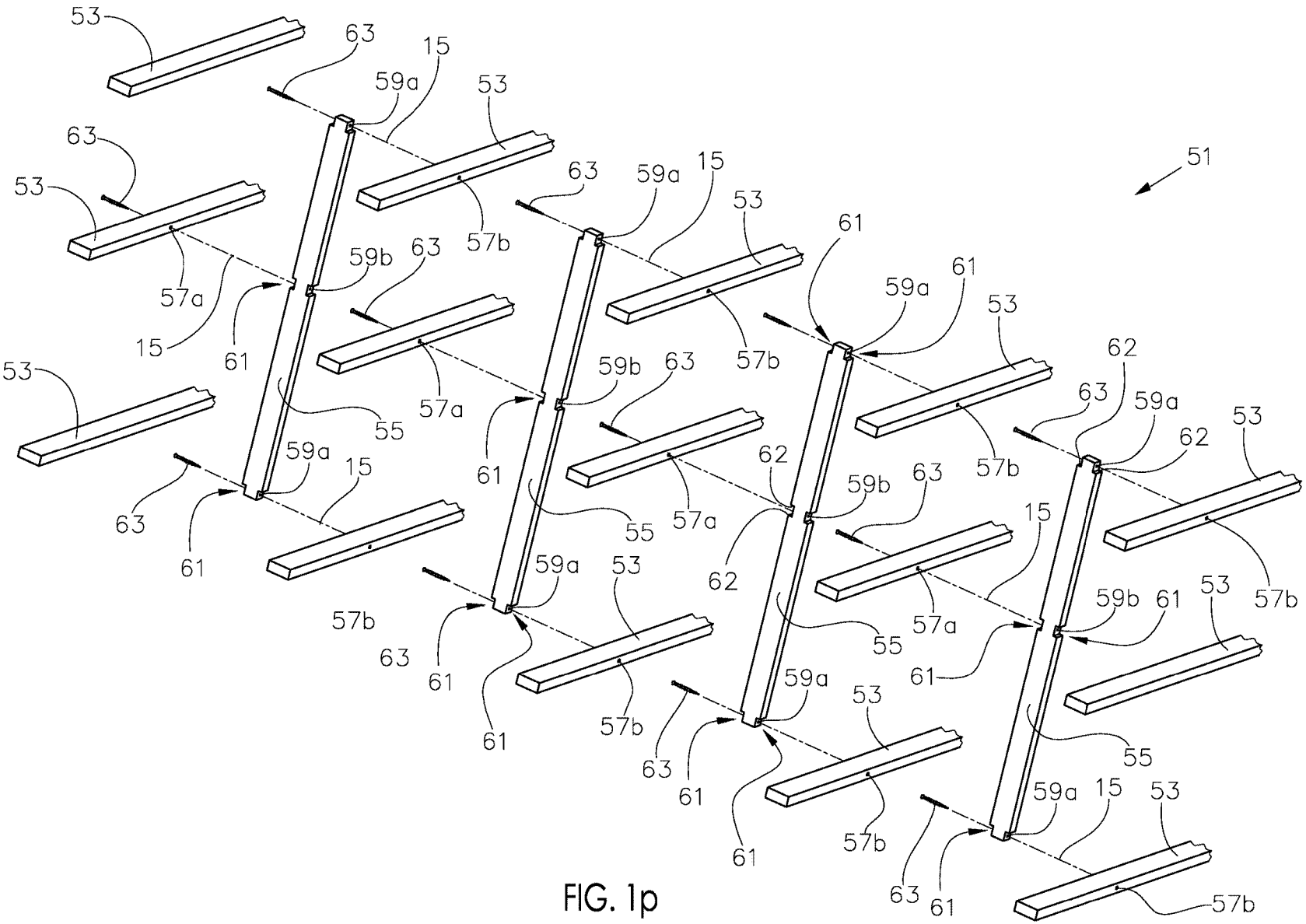
Figure 1Q:
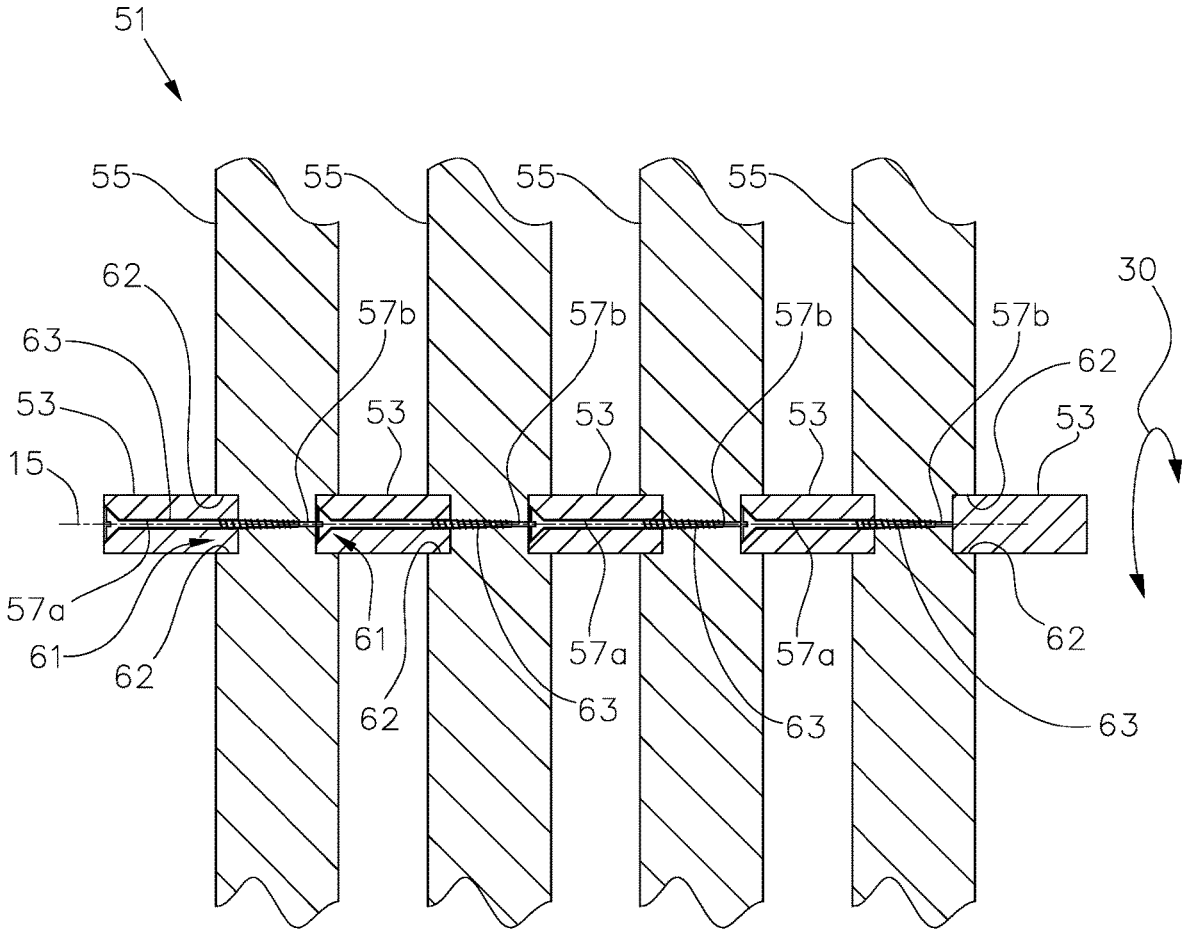
Figure 5A:
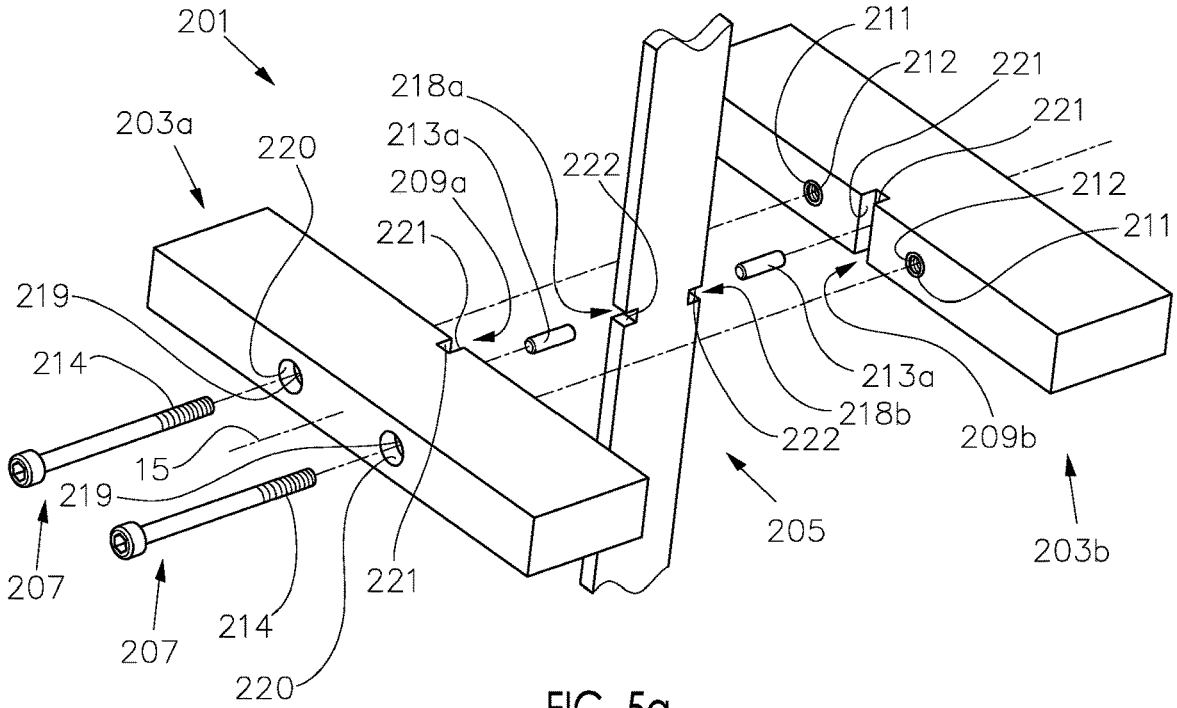

FIG. 1*f* is a cross section detail view of the embodiment of FIG. 1*a*, taken along 17-17;

FIG. 1*g* is a perspective detail view of the embodiment of FIG. 1*a*, as assembled, illustrating direction and orientation definitions used in this disclosure;

FIG. 1*h* is a schematic plan view of the embodiment of FIG. 1*a*, illustrating the relationship between orthogonal vertical and horizontal members, also including certain definition conventions used in this disclosure, such as the crossover region;

FIG. 1*i* is a schematic plan view of the embodiment of FIG. 1*a*, illustrating certain definition conventions used in this disclosure, including a binding element extending through the crossover region;

FIG. 1*j* is a schematic plan view of a second embodiment of the present invention, illustrating the relationship between non-orthogonal vertical and horizontal members, also including certain definition conventions used in this disclosure, such as the crossover interface;

FIG. 1*k* is a schematic plan view of the embodiment of FIG. 5*a*, illustrating certain definition conventions used in this disclosure, including a binding element that is offset and extends external to the crossover interface and within the horizontal member;

FIG. 1L is a schematic plan view of a third embodiment of the present invention, illustrating certain definition conventions used in this disclosure, including a binding element extending externally to the crossover interface and within the horizontal member;

FIG. 1*m* is a cross section detail view of the embodiment of FIG. 1*a*, taken along 17-17, illustrating a loose blocking keyed engagement interface;

FIG. 1*n* is a cross section detail view of a fourth embodiment of the present invention, corresponding to the view of FIG. 1*f*, illustrating a camming keyed interface;

FIG. 1*p* is an exploded perspective view of a fifth embodiment of the present invention, corresponding to the view of FIG. 1*b*, including short binding screws to only bind adjoining vertical and horizontal members;

FIG. 1*q* is a cross section detail view of the embodiment of FIG. 1*p*, as assembled, corresponding to the view of FIG. 1*f;*

Figure 2A:
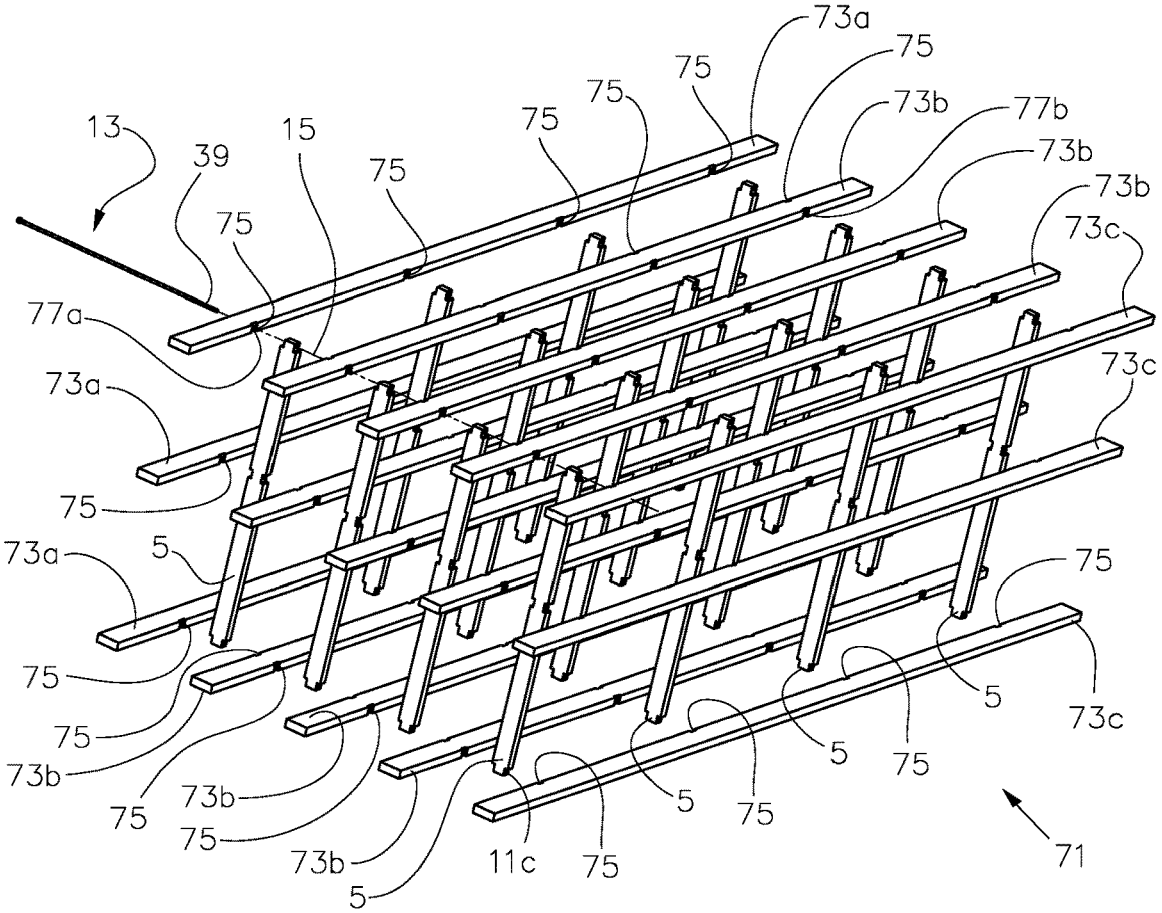
Figure 2B:
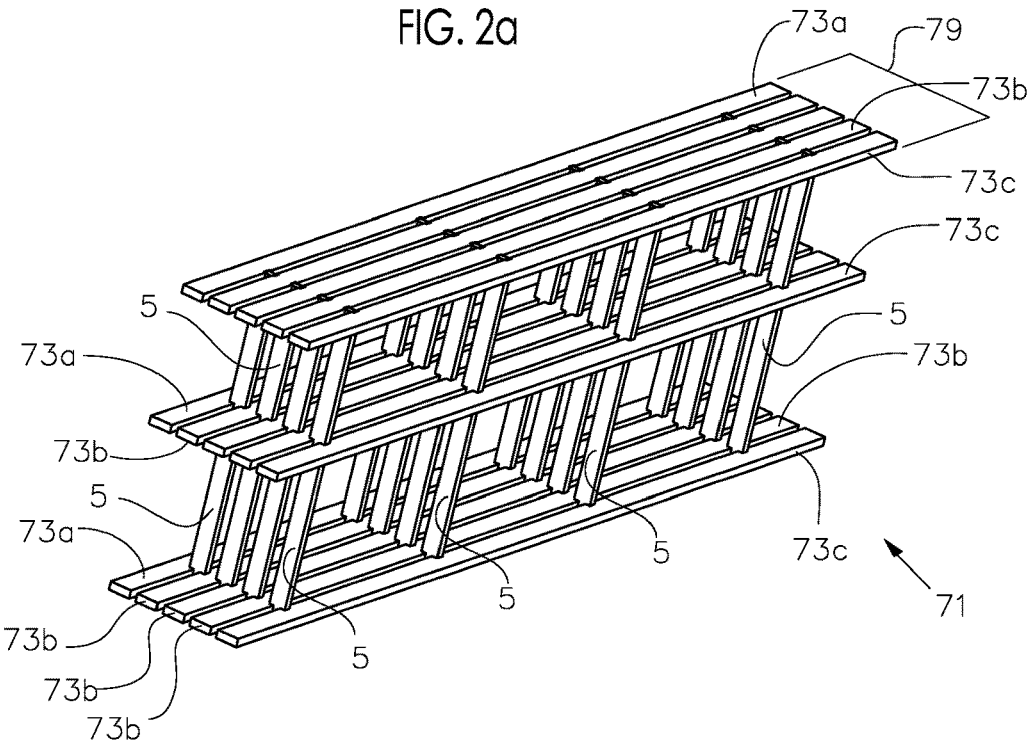
Figure 2C:
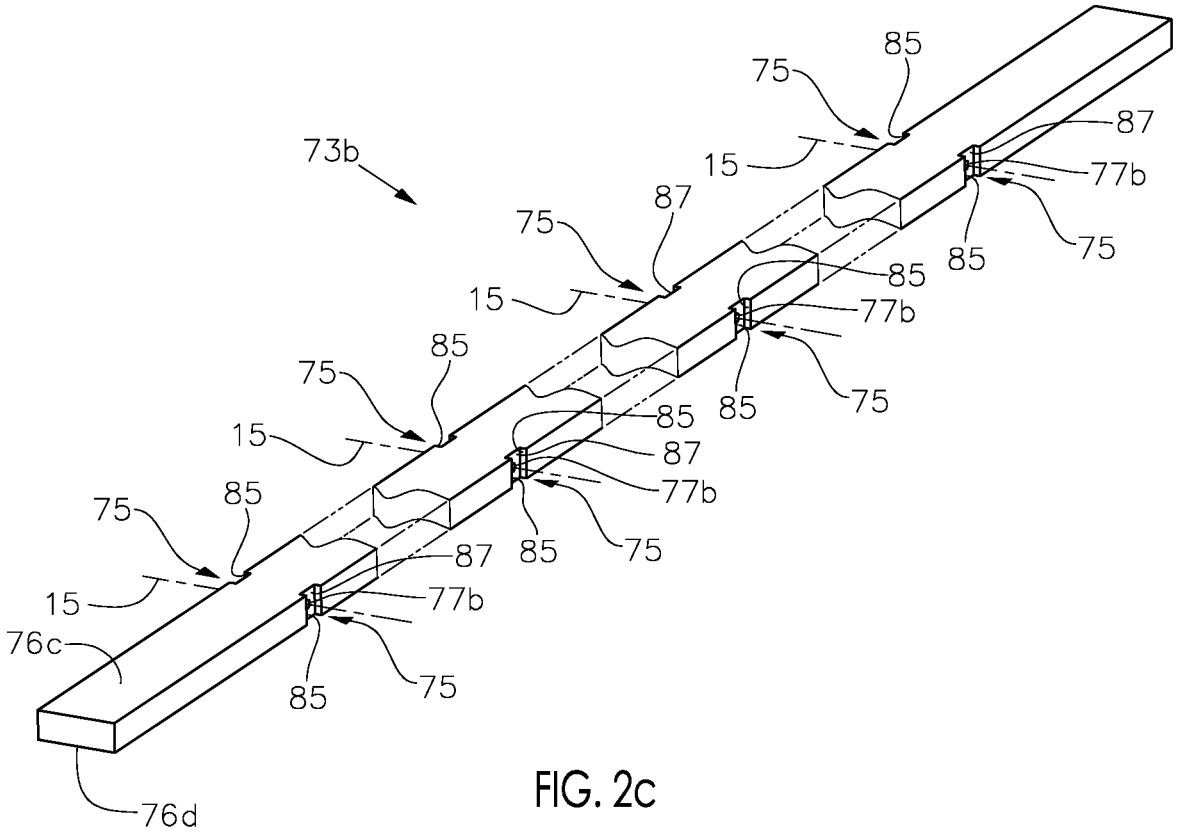

FIG. 2*a* is an exploded perspective view of a sixth embodiment of the present invention, similar to the embodiment of FIG. 1*a*, with the exception that the slats are also notched to interlock with the adjoining rails;

FIG. 2*b* is a perspective view of the embodiment of FIG. 2*a*, as assembled;

FIG. 2*c* is a broken perspective view of a slat of the embodiment of FIG. 2*a;*

Figure 3A:
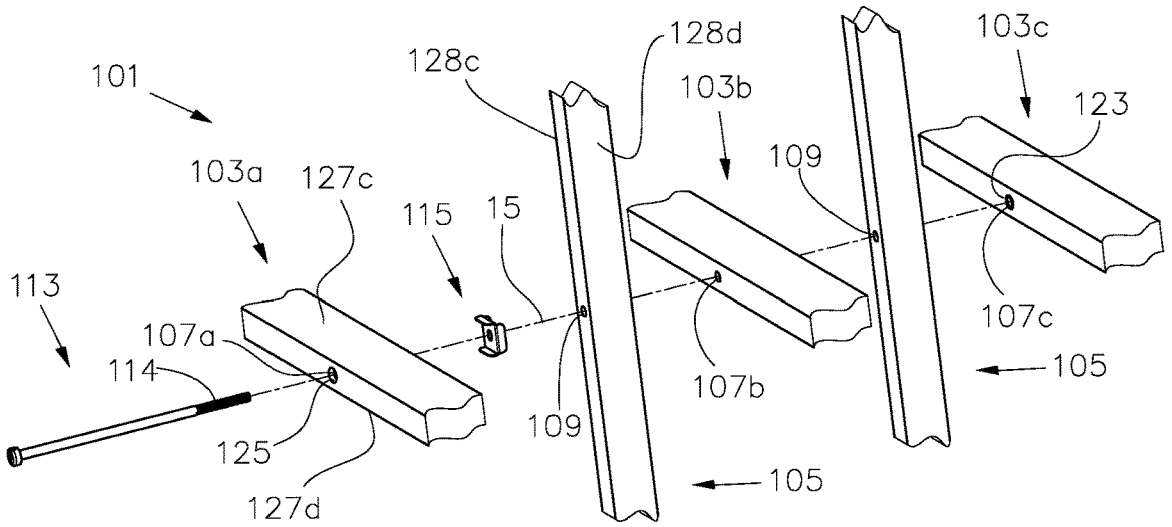
Figure 3B:
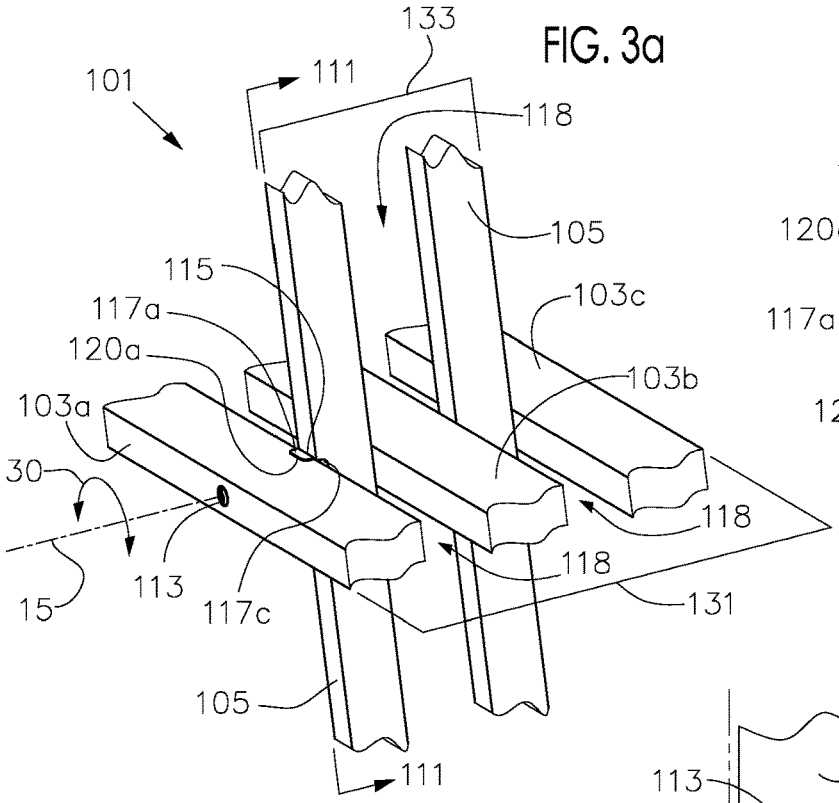
Figure 3C:
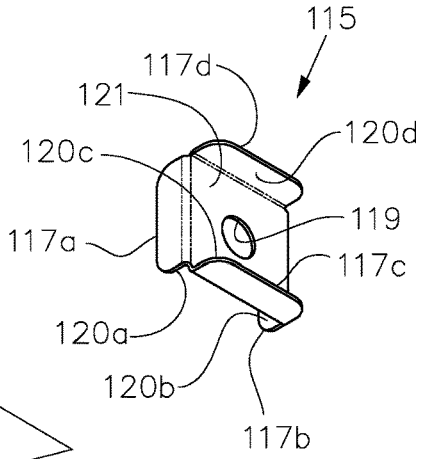

FIG. 3*a* is an exploded perspective detail view of a seventh embodiment of the present invention, similar to the embodiment of FIG. 1*a*, with the exception that the notches have been omitted in favor of locating clip(s) that serve as an intermediate element to interlock and key the slats with the adjoining rails;

FIG. 3*b* is a perspective view of the embodiment of FIG. 3*a*, as assembled;

FIG. 3*c* is a perspective view of the clip of FIG. 3*a;*

Figure 3D:
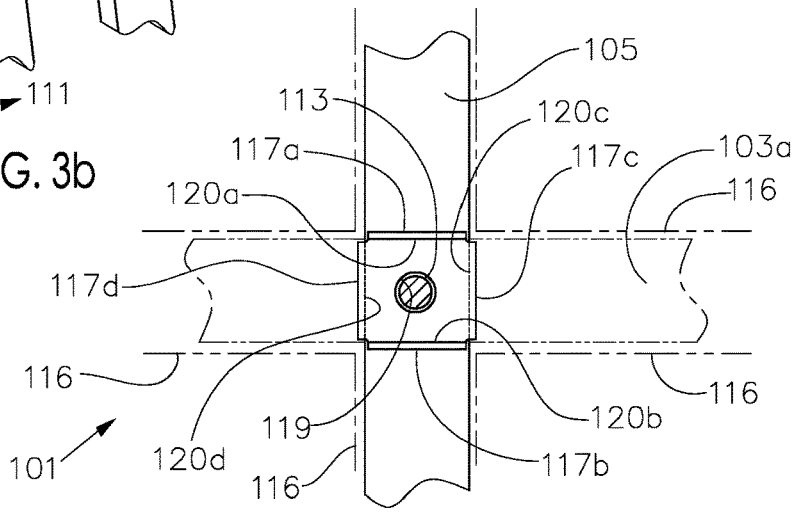
Figure 4A:
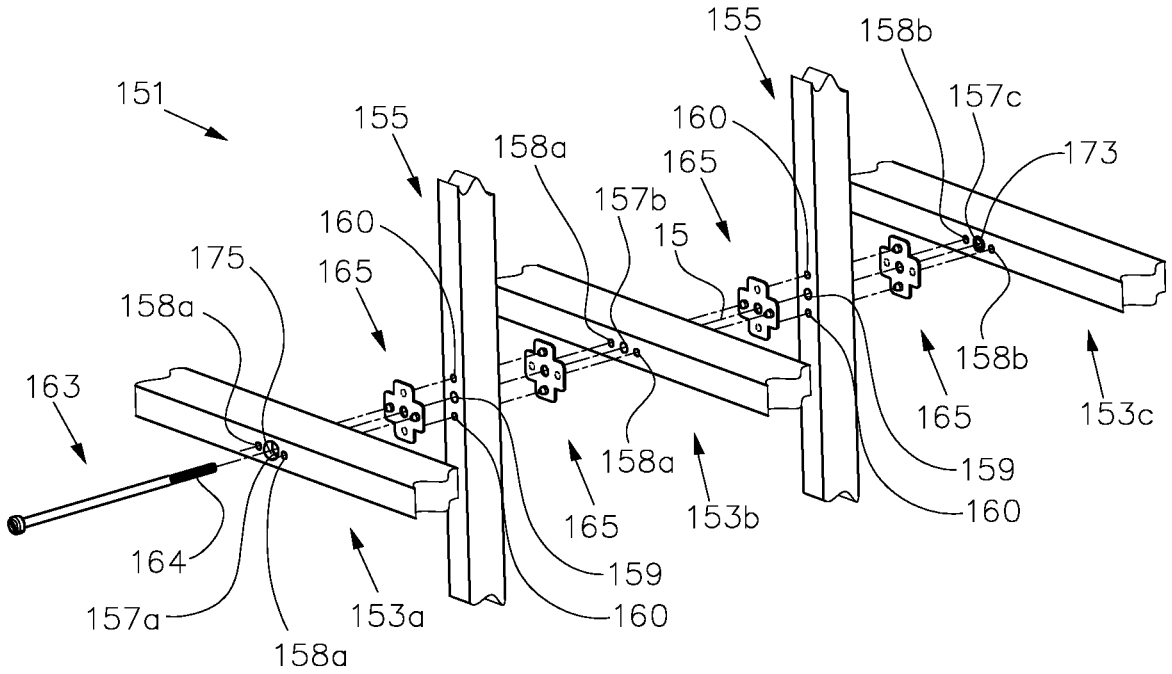
Figure 4B:
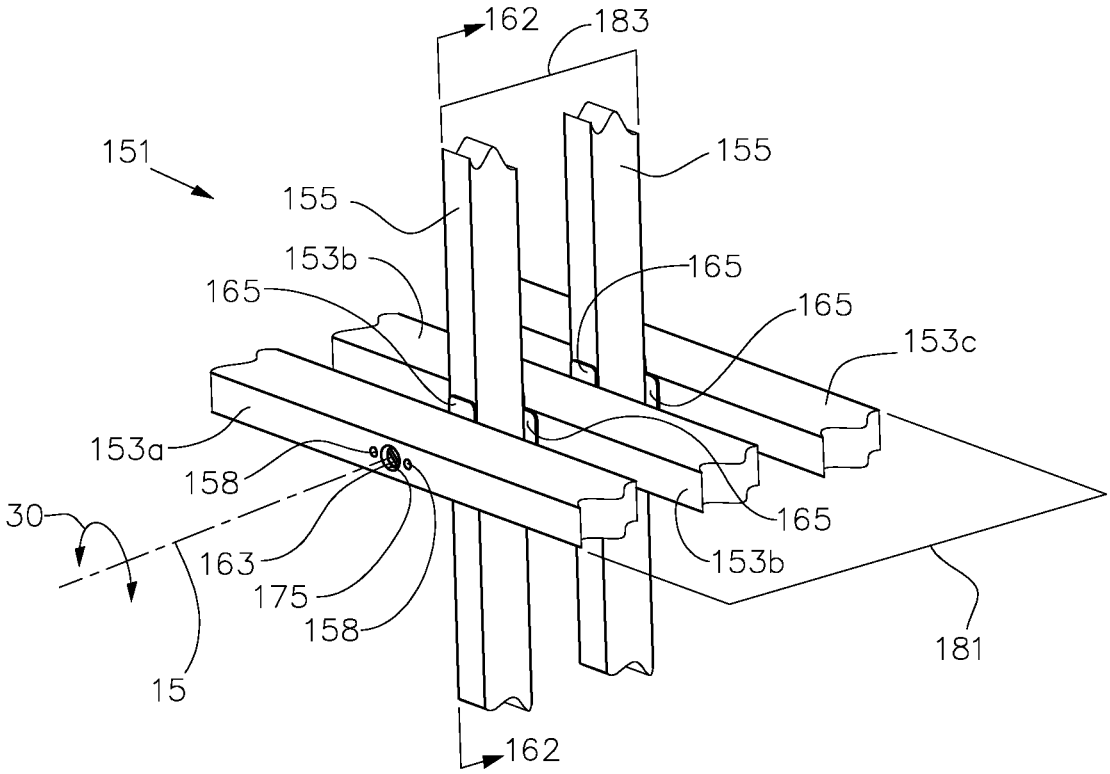
Figure 4C:
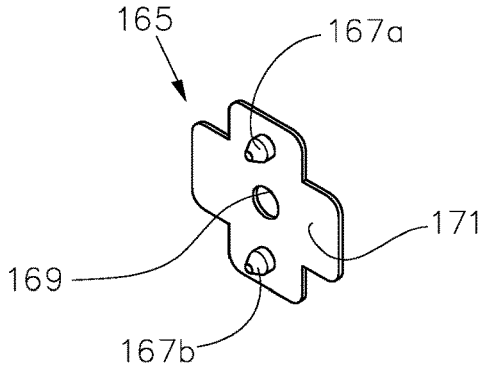

FIG. 3*d* is an orthogonal plan cross section view, taken along 111-111, of the embodiment of FIG. 3*a*, as assembled;

FIG. 4*a* is an exploded perspective detail view of a eighth embodiment of the present invention, similar to the embodiment of FIG. 1*a*, with the exception that the notches have been omitted in favor of locating tabs that serve as an intermediate element to interlock the slats with the adjoining rails;

FIG. 4*b* is a perspective view of the embodiment of FIG. 4*a*, as assembled;

FIG. 4*c* is a perspective view of the locating tab of the embodiment of FIG. 4*a;*

Figure 4D:
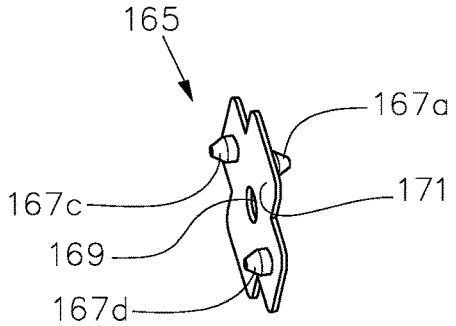

FIG. 4*d* is a perspective view of the locating tab of the embodiment of FIG. 4*a;*

Figure 4E:
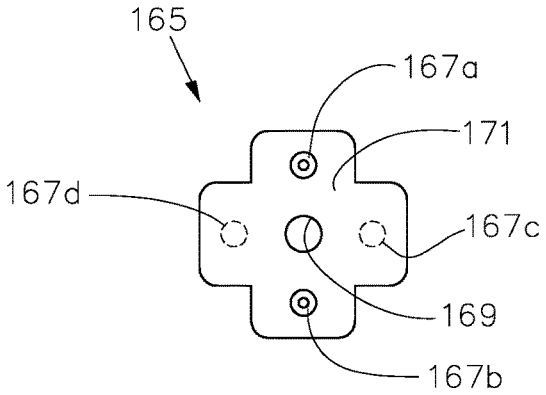

FIG. 4*e* is an orthogonal front plan view of the locating tab of the embodiment of FIG. 4*a;*

Figure 4F:
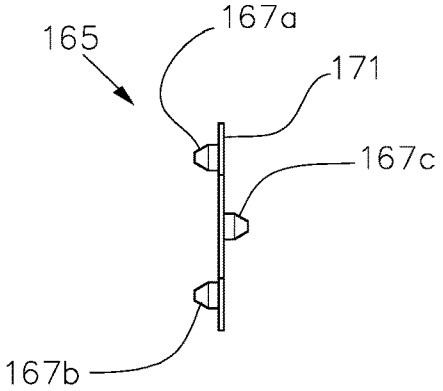

FIG. 4*f* is an orthogonal side view of the locating tab of the embodiment of FIG. 4*a;*

Figure 4G:
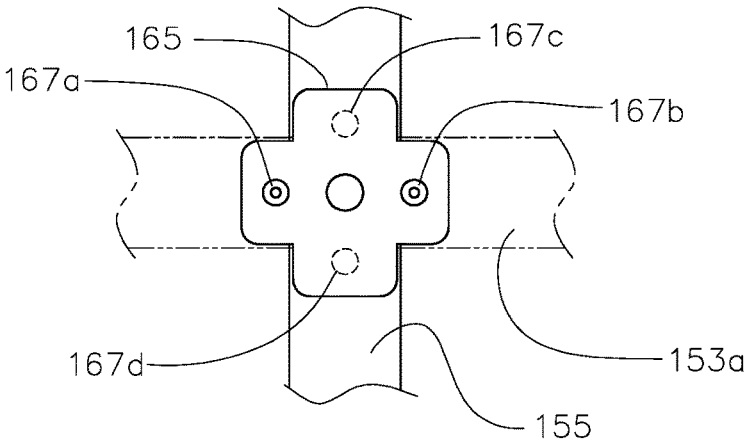
Figure 5B:
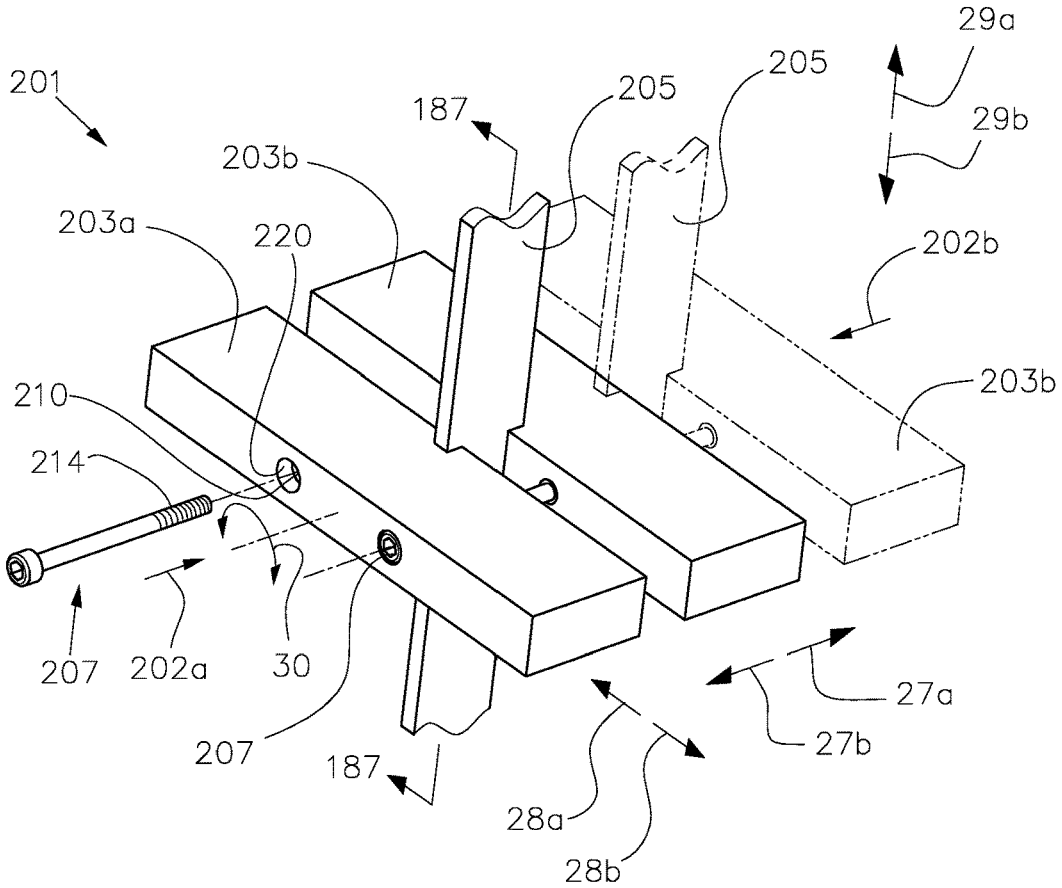
Figure 5C:
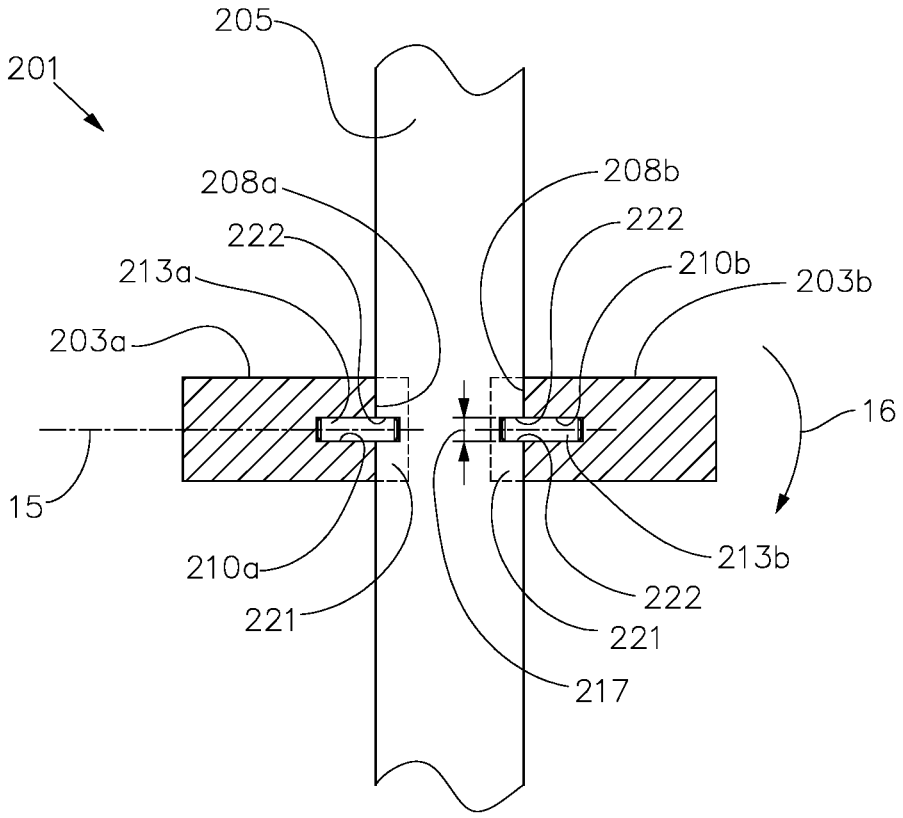

FIG. 4*g* is an orthogonal plan cross section view, taken along 162-162, of the embodiment of FIG. 4*a*, as assembled;

FIG. 5*a* is an exploded perspective detail view of a ninth embodiment of the present invention, where the rail is rotationally and translationally keyed to the slats and the binding screw extends outside of the crossover interface and within the slats;

FIG. 5*b* is a perspective view of the embodiment of FIG. 5*a*, as assembled;

FIG. 5*c* is a cross sectional view, taken along 187-187, of the embodiment of FIG. 5*a*.

FIGS. 1*a-m* describes a first embodiment of the present invention as well as some of the directions and conventions used throughout the instant application. Shelf assembly 1 is made up of fifteen slats 3*a-c*, sixteen rails 5, and twelve binding screws 13.

As particularly shown in FIGS. 1*a* and 1*g*, direction 27*b* is a "rearward" or "rear" direction and direction 27*a* is a "forward" or "front" direction. Direction 28*a* is a horizontal and laterally "sideways" or "leftward" direction and direction 28*b* is a horizontal and laterally "sideways" or "rightward" direction opposed to direction 28*a*. Direction 29*a* is a lateral and vertical "upward", "upper", or "raised" direction and direction 29*b* is a lateral and vertical "downward", "down", or "lower" direction. Cross axis 15 is the axis where the slats 3*a-c* cross the rails 5 and is aligned to be generally perpendicular to both the slat axis 14 and rail axis 18 to extend axially through the crossover region 35. The "axial" direction is a direction parallel to the cross axis 15 and generally parallel to directions 27*a* and 27*b*. An axially outward or axially outboard direction is a direction away from the axial midpoint of the stack of slats 3*a-c* and rails 5. The "lateral" direction is a direction generally perpendicular to the cross axis 15, and the circumferential direction 30 is an arcuate direction of rotation about the cross axis 15. When viewing the shelf assembly 1 along the axial direction or in the plan view, the crossover region 35 is the projected area of crossover overlap between a given slat 3*a-c* and a given rail 5. The crossover interface is the portion of the crossover region, where a horizontal member (i.e. slat 3*a-c*) axially abuts an adjacent vertical member (i.e. rail 5). In most of the embodiments herein, the "crossover interface" constitutes the entirety of the "crossover region" and these two terms may be used interchangeably. As shown, the cross axis 15 generally extends through the crossover region. The terms "slat" and "horizontal member" are used interchangeably herein, although the "horizontal member" may not necessarily be horizontal. Similarly, the terms "rail" and "vertical member" are used interchangeably herein. As a general rule, a horizontal member is commonly closer to horizontal than the vertical member. While the "vertical member" may not necessarily be vertical, it is an element that crosses and/or intersects the "horizontal member" as viewed along the cross axis 15 or in the plan view as shown in FIG. 1*d*, where the slat axes 14 also cross the rail axes 18. In the shelf application shown in FIGS. 1*a-m*, the slats 3*a-c* are shown to be generally horizontal in order to provide an upwardly-facing shelf surface upon which to place external items, such as books, etc.

Slats 3*a-c* make up the shelf 31 portions of the shelf assembly 1. Slats 3*a-c* each include a forward surface 20*a*, a rearward surface 20*b*, an upper surface 20*c* and a lower surface 20*d*, and a slat axis 14. As shown in FIGS. 1*a-d*, there are five total slats 3*a-c* that make up each shelf 31. There are three slats 3*a* that serve as the furthest rearward horizontal members of each respective shelf 31, each having a series of four through holes 7*a* and counterbores 25 aligned along cross axis 15. There are nine slats 3*b* that serve as the middle horizontal members with three slats 3*b* corresponding to each respective shelf 31. Each slat 3*b* has a series of four through holes 7*b* aligned along cross axis 15. There are three slats 3*c* that serve as the furthest forward horizontal members of each respective shelf 31, each having a series of four blind holes 7*c* aligned along cross axis 15. Holes 7*c* include internally threaded inserts 23 fixed therein that threadably accept the external threads of binding screws 13. Slats 3*a-c* have a thickness dimension 38 between their upper surface 20*c* and a lower surface 20*d*. As shown in FIGS. 1*a-d*, there are five total slats 3*a-c* that make up each shelf 31.

Rails 5 serve as generally vertical members that make up the upright 33 portions of the shelf assembly 1. As shown in FIGS. 1*a-d*, there are four rails 5 that make up each upright 33. Each rail 5 includes three through holes 9*a-c*, each set within a corresponding pair of axially opposed notches 11*a-c*, each notch 11*a-c* having a step-recessed bottom surface 10 flanked by one or two keying surfaces 12. Notches 11*a* are centered on holes 9*a* and each includes an upward-facing key surface 12. Notches 11*b* are centered on holes 9*b* and each includes a pair of vertically opposed key surfaces 12 that are vertically separated by dimension 34. Rails 5 each include a front surface 19*a*, a rear surface 19*b*, a left surface 19*c* and a right surface 19*d*, and a rail axis 18. Notches 11*c* are centered on holes 9*c* and each includes downward-facing key surface 12. Notches 11*a-c* are shown here to be open at their intersection with left surface 19*c* and right surface 19*d* to allow slats 3*a-c* to extend though. Binding screws 13 are of conventional configuration and include a shank with external machine threads 39, an enlarged head 41 with a hex socket or similar feature for manual manipulation, and a shoulder 43 between the shank and head.

It is envisioned that the slats 3*a-c* and rails 5 be made of wood, as this is the common material for shelf assemblies. However, it is also considered that slats 3*a-c* and rails 5 may be made of plastic or metal or any other suitable material. It is also anticipated that a combination of materials may be utilized, including the combination where slats 3*a-c* are made of one material and the rails 5 are made of another material.

FIGS. 1*a-b* show the components of shelf assembly 1 in exploded view prior to assembly. Holes 7*a-c* and 9*a-c* are aligned with cross axis 15 and are sized to receive binding screws 13.

FIGS. 1*c*, 1*d*, and 1*f* show the shelf assembly 1 as next assembled with rails 5 alternately interleaved between slats 3*a-c* as shown such that holes 7*a-c* and 9*a-c* are colinearly aligned and with binding screws 13 extending therethrough. Slats 3*a* and 3*c* serve to bookend the axially interleaved stack of rails 5 and slats 3*b*. The axial overlap between binding screws 13 and holes 7*a-c* and 9*a-c* serve to laterally align the slats 3*a-c* and rails 5. As the external threads 39 of binding screws 13 are threadably tightened with the internal threads of their respective mating thread inserts 23 (as particularly shown in FIG. 1*f*), the shoulders 43 bear against the transition between their respective holes 7*a* and counterbores 25. The axial stack of slats 3*a-c* and rails 5 are thereby brought together along the cross axis 15, with slats 3*a-c* directly abutting rails 5 along the cross axis 15 and also nesting within adjoining notches 11*a-c* as shown. Concurrently, the key surfaces 12 axially overlie and overlap their adjoining slats 3*a-c*, creating an interlocking engagement therebetween. Binding screws 13 serve to axially bind the axial stack of slats 3*a-c* and rails 5.

As the binding screws 13 are further threadably tightened and cinched with their respective thread inserts 23, slats 3*a* and 3*c* are axially drawn toward each other with axially inward pressure to solidly clamp, squeeze, and sandwich the respective adjoining stack of rails 5 and slats 3*b* and to solidly nest and abut the forward surfaces 20*a* and/or rearward surfaces 20*b* of slats 3*a-c* against bottom surfaces 10 within their mating notches 11*a-c*. The result is a solidly abutting stack of rails 5 and slats 3*a-c* to minimize any flex or sag of the shelf assembly 1 and to withstand common shelving loads. The tightened binding screws 13 are thereby tensioned, causing bottom surfaces 10 to press and bear against their adjoining forward surfaces 20*a* and/or rearward surfaces 20*b*. This contact interface pressure serves to maintain the square and orthogonal alignment of the slats 3*a-c* relative to rails 5 and provides further resistance to any tilting displacement 16 (about an axis along directions 28*a-b*) of the slats 3*a-c* due to shelf load and/or the weight of the shelf assembly 1 itself. This contact pressure also serves to provide resistance to any twisting displacement (about an axis along directions 29*a-b*) of the rails 5 relative to slats 3*a-c*. The shelf assembly 1 may now be mounted to a base structural element, such as a wall or floor, to support shelving loads in the conventional manner.

Since binding screw 13 extends through both holes 7*a-c* and their corresponding collinear holes 9*a-c*, it is understood that, like a dowel pin, the binding screw 13 serves to interlock the rails 5 and slats 3*a-b* to restrict, limit, and/or prevent movement in directions 28*a-b* and 29*a-b* between adjoining slats 3*a-c* and rails 5. Further, it is noted that the axially overlying engagement and interlock between keying surfaces 12 and their mating upper surfaces 20*c* and/or lower surfaces 20*d* of the slats 3*a-c* thereby serving to restrict and/or prevent movement in directions 29*a* and/or 29*b* between adjoining slats 3*a-c* and rails 5. Thus, the numerous interlocked and bound engagements of this embodiment serves to provide a robust shelf assembly 1.

Since key surfaces 12 are aligned to have a close fit with the respective adjacent upper surfaces 20*c* and/or lower surfaces 20*d* of mating slats 3*a-c*, the axial overlie and overlap therebetween results in a keying interface that serves to provide a circumferential keyed engagement therebetween to prevent and/or limit rotation between slats 3*a-c* and their mating rails 5 about the cross axis 15 (i.e. in direction 30).This keyed engagement restricts rotational displacement in both circumferential directions 30 and is thus considered a bi-directional keyed engagement that serves to maintain a perpendicular and orthogonal alignment between slats 3*a-c* and rails 5 and correspondingly between shelves 31 and uprights 33 (as viewed in the plan view).

In other words, this keyed engagement serves to limit "parallelogramming" or racking (i.e. pivoting distortion) of the shelf assembly 1, thus keeping the shelves 31 and the uprights 33 perpendicularly aligned to each other, preferably without necessitating any additional web or diagonal bracing as is common with conventional shelf assemblies. As shown here, notches 11*a-c* and key surfaces 12 are formed directly in the rails 5. As such, this circumferentially keyed engagement interface occurs directly between the slats 3*a-c* and rails 5.

While it is commonly desirable to maintain perpendicular alignment (as viewed in the plan view) between slats 3*a-c* and rails 5 and correspondingly between shelves 31 and uprights 33 as shown in FIGS. 1*a-i*, it is also anticipated that the aforementioned key surfaces 12 may alternatively be aligned to maintain a non-perpendicular and non-orthogonal alignment (as viewed in the plan view) between slats 3*a-c* and rails 5, and correspondingly between shelves 31 and uprights 33. Such a non-perpendicular arrangement is shown in FIG. 1*j*, including an acute angle 45 between slat 65 and rails 66.

As shown in FIG. 1*g*, the sandwiched and interleaved axial stack of slats 3*a-c* and rails 5 serve to provide an axial separation or gap 68 between adjacent slats 3*a-c* and an axial separation or gap 69 between adjacent rails 5. These gaps 68 and 69 serve to provide an open lattice of slats 3*a-c* and rails 5 and to create both ventilated shelves 31 and ventilated uprights 33. These gaps 68 and 69 permit light to enter the openings 4, also creating a open and airy aesthetic to the shelf assembly 1. Gaps 68 and 69 also reduce the weight of the shelf assembly 1 and reduce the overall amount of material (and cost) required, as compared with conventional panel-type shelf assembly construction.

FIG. 1*h* is a schematic plan view that illustrates the crossover region 35 as well as the crossover perimeter 36 of the crossover region 35. Rail 5 and corresponding upright 33 is shown to be orthogonal to slat 3*b* and corresponding shelf 31. Openings 47 of shelf assembly 1 are defined as the cavity between the shelves 31 and uprights 33. As shown in this embodiment, the crossover region 35 corresponds to the axially abutting interface surface between the rails 5 and slats 3*a-c*.

FIG. 1*i* is a schematic plan view that shows the binding screw 13 as passing axially through the crossover region 35 within the bounds of the crossover perimeter 36, corresponding to the embodiment of FIGS. 1*a-h*. It is also noted that holes 9*b* and 7*b* also extend axially through the crossover region 35. Since the binding screw 13 passes through both holes 7*b* of the slat 3*b* and hole 9*b* of rail 5, the binding screw also serves to limit lateral movement of slat 3*ba* relative to rail 5 band vice versa. In other words, binding screw 13 acts as a peg to key slats 3*b* with their adjoining rails 5. There is shown to be slight clearance between holes 7*b* and 9*b* and the binding screw 13 for ease of assembly.

FIG. 1*k* is a schematic plan view that describes an embodiment where the binding screw 207 is shown to pass through a hole 219 in the slat 203*a* in a region laterally outboard of the crossover region 215 and outside of the bounds of the crossover perimeter 216. This arrangement corresponds to the embodiment of FIGS. 5*a-c*. Note that the binding screw 207 may alternatively be shown to pass through the rail 205 in a region laterally outboard of the crossover region 215 instead of (or in addition to) the binding screw 207 passing through the slat 203*a* as shown in FIG. 1*k*.

FIG. 1L is a schematic plan view that describes an alternate embodiment where two binding screws 13 are shown to pass external to the slat 223*b* in a region laterally outside of the bounds of the crossover region 229 and crossover perimeter 227 and also outside of both the slat 223*b* and rail 225. These In this case, a bridge plate 231 is used in the conventional manner to transfer the tension of the binding screws 13 to the slat 223*b* and to impart an axially inward clamping force to bind the axial stack of interleaved slats 223*b* and rails 225.

FIG. 1*m* is a view that corresponds to FIG. 1*f*, however FIG. 1*m* shows a small lateral clearance 49 between key surfaces 12 and the mating upper and/or lower surfaces of slats 3*a-c*. While the clamping tension provided by the binding screws 13 results in a good degree of friction between the axially abutting forward surfaces 20*a* and rearward surfaces 20*b* of the slats 3*a-c* and mating bottom surface 10 of notches 11*b* to resist circumferential displacement therebetween and the associated racking and "parallelogramming" of the shelf assembly 1. However, this friction may be overcome due to shelving loads. For this reason, the aforementioned keyed engagement between the key surfaces 12 and the upper and lower surfaces of the slats 3*a*, 3*b*, and/or 3*c* is beneficial to insure that any circumferential displacement therebetween is positively limited and restricted. FIG. if shows minimal or zero vertical clearance between the key surfaces 12 and the mating upper and lower surfaces of mating slats 3*a-c*, with dimension 38 shown to be closely matched to distance 34. This is the preferred arrangement and it is further preferred that there be a slight interference fit between dimension 34 and dimension 38 so that slats 3*a-c* must be press-fit to nest into their mating notches 11*a-c*, thus insuring zero clearance between the key surfaces 12 and the mating upper and lower surfaces of mating slats 3*a-c*. In contrast, FIG. 1*m* shows that distance 34 is slightly larger than dimension 38, resulting in keying interface that has a clearance 49 between the key surfaces 12 and the mating upper and lower surfaces of mating slats 3*a-c*. This allows a small degree of possible circumferential freeplay therebetween, potentially permitting a small degree of racking or "parallelogramming" of the shelf assembly 1.

As shown in the FIGS. 1*a-i*, keying surfaces 12 are aligned to be parallel with the upper and/or lower surfaces of slats 3*a-c* and to be perpendicular to bottom surface 10. This results in an overlapping overlie engagement that is parallel to the cross axis 15. As such, this arrangement provides a blocking resistance to circumferential displacement (in direction 30), as well as longitudinal vertical displacement (in directions 29*a* and/or 29*b*), between mating slats 3*a-c* and rails 5. With blocking resistance, if there were a racking or parallelogramming load on the shelf assembly, the keying interface between the keying surfaces 12 and mating slats 3*a-c* would not induce axial load in the binding screws 13.

FIG. 1*n* corresponds to FIG. 1*f*, but instead shelf assembly 148 shows rails 135 to have notches 137 in the form of a concave "V" shaped profile with flanks 143 at an angle 141. Similarly, slats 139 have front and/or rear surfaces with a convex "V" shaped profile with flanks 145 also at angle 141. The convex profile of the slats 139 includes flanks 145 that are shown to be nested with the concave notches 137 in a manner similar to the way slats 3*a-c* are nested in notches 11. However, since flanks 145 and 143 are angled and are non-orthogonal, any racking/parallelogramming load applied to the shelf assembly will cause circumferential load in direction 30 to be applied at the interface where flanks 143 and 145 contact, which will also cause flanks 143 and 145 to cam off of each other, thereby imparting an axial separation load 147 between adjoining slats 139 and rails 135. This is considered a non-blocking and camming keyed engagement interface. As such this separation load 147 results in additional tension being placed on the binding screw 13 and, since slats 139, rails 135 and binding screws 13 are not infinitely rigid, the arrangement of FIG. 1*n* may potentially have a less rigid resistance to racking and "parallelogramming" displacement of the shelf assembly 1 as compared to a blocking resistance (described hereinabove).

The shelf assembly 51 of FIGS. 1*p-q* is identical to the shelf assembly 1 of FIG. 1*a-i* in most respects with the exception that the binding screws 13 are omitted in favor of screws 63. Screws 63 are conventional self-tapping flathead wood screws having a length long enough only to axially bind a single slat 53 to a single rail 55 and vice versa. Slats 53 are generally similar to slats 3*b* and include either clearance holes 57*a* or pilot holes 57*b* in place of holes 7*b*. Rails 55 are generally identical to rails 5, except that they include either clearance holes 59*a* or pilot holes 59*b* in place of holes 9*b*. Clearance holes 57*a* and 59*a* are sized to receive the shank of their respective screw 63 and have a countersink (obscured) to receive the tapered flathead shoulder of screws 63 at their obscured entry for a flush appearance in the conventional manner. Holes 57*b* and 59*b* are pilot holes sized for a self-tapping thread engagement with the external threads of screw 63 in the conventional manner. Notches 61 and key surfaces 62 are otherwise identical to notches 11 and key surfaces 12.

FIG. 1*p* is a detail view that corresponds to FIG. 1*b* and it is understood that there may be additional rails 55 spaced rearwards from the rails 55 shown, in an arrangement similar to that shown in FIG. 1*a*. It may be seen that rails 55 are drilled such that holes 59*a* and 59*b* are collinear and alternating between adjacent rails 55 as shown. Similarly, slats 53 are drilled such that holes 57*a* and 57*b* are collinear and alternating between adjacent slats 53 as shown. Slats 53 and rails 55 are arranged so that one series of screws 63 are assembled to pass forwardly through their respective clearance hole 57*a* of a given slat 53 and are threadably self-tapped within the corresponding collinear pilot hole 59*b* of the adjoining rail 55. Another series of screws 63 are assembled to pass forwardly through their respective clearance hole 59*a* of a rail 55 and are threadably self-tapped into the corresponding collinear pilot hole 57*b* of the adjoining slat 53. When all of the screws 63 are threadably tightened to join alternating slat 53 and rail 55 junctures, the axial overlap between screws 63 and holes 57*a-b* and 59*a-b* serve to laterally align the slats 53 and rails 55. Key surfaces 62 engage to slats 53 in a manner identical to the engagement between key surfaces 12 and slats 3*a-c* described in FIGS. 1*a-i*.

As illustrated in FIG. 1*q*, screws are used to axially secure alternating sets of slats 53*a-c* and rails 55 in the axial stack of these members along a given cross axis 15. This alternating sequence may be staggered between adjacent cross axes 15 and also staggered along the sideways directions 28*a* and 28*b*, as shown in FIG. 1*p*, such that the full complement of slats 53*a-c* and rails 55 are secured to each other in assembling the shelf assembly 51.

When the external threads of screws 63 are threadably tightened in a self-tapping engagement with the pilot holes 57*b* and 59*b*, their flared shoulders bear against the countersinks of holes 57*a* and 59*a*. The slats 53 and rails 55 are thereby axially bound and clamped to each other at laterally alternating crossover regions and in an axially staggered arrangement, with slats 53 nesting within adjoining notches 61 as shown. Concurrently, the key surfaces 62 axially overlap their adjoining slats 53 to provide a circumferential keyed engagement therebetween to prevent and/or limit circumferential rotation between adjoining slats 53 and rails 55 in direction 30, as also described in FIGS. 1*a-i*. This serves to solidly connect the slats 53 and rails 55 to each other and to limit and/or prevent parallelogramming or circumferential movement therebetween. The resulting fully-assembled shelf assembly 51 may now be mounted to a structural element, such as a wall or floor, to support shelving loads in the conventional manner.

When the external threads of screws 63 are threadably tightened in a self-tapping engagement with the pilot holes 57*b* and 59*b*, their flared shoulders bear against the countersinks of holes 57*a* and 59*a*. The slats 53 and rails 55 are thereby axially bound and clamped to each other at laterally alternating crossover regions in an axially staggered arrangement, with slats 53 nesting within adjoining notches 61 as shown. Concurrently, the key surfaces 62 axially overlap their adjoining slats 53 to provide a circumferential keyed engagement therebetween to prevent and/or limit circumferential rotation between adjoining slats 53 and rails 55 in direction 30, as also described in FIGS. 1*a-i*. This serves to solidly connect the slats 53 and rails 55 to each other and to limit and/or prevent parallelogramming or circumferential movement therebetween. The resulting fully-assembled shelf assembly 51 may now be mounted to a structural element, such as a wall or floor, to support shelving loads in the conventional manner.

The shelf assembly 71 of FIGS. 2*a*-c is identical to the shelf assembly 1 of FIG. 1*a-f* in most respects with the exception that the slats 73*a-c* are substituted for respective slats 3*a-c*. Rails 5 and binding screws 13 are identical to those shown in FIGS. 1*a-f*. There are three slats 73*a* that serve as the furthest rearward horizontal members of each shelf 79, each having a series of four through holes 77*a* and counterbores (obscured, but identical to counterbore 25 of FIGS. 1*a-f*) aligned along cross axis 15, each with forward-facing notches 75 centered thereon. Notches 75 are shown here to be open at their intersection with upper surface 76*c* and lower surface 76*d* to allow rails 5 to extend though as shown in FIG. 2*b*. There are nine slats 73*b* that serve as the middle horizontal members of each shelf 79, each having a series of four through holes 77*b* aligned along cross axis 15, each with a pair of forward-facing and rearward-facing notches 75 centered thereon. There are three slats 73*c* that serve as the furthest forward horizontal members of each shelf 79, each having a series of four blind holes 77*c* (obscured, but identical to holes 7*c*) aligned along cross axis 15, each with rearward-facing notches 75 centered thereon. Holes 77*c* include internally thread inserts 78 (obscured, but identical to thread inserts 23) fixed therein that threadably accept the external threads 39 of binding screws 13. Notches 75 of slats 73*a-c* each includes sideways-opposed key surfaces 85 and bottom surface 87. It is noted that multiple binding screws 13 are utilized as described in FIGS. 1*a-f*.

FIG. 2*b* show the shelf assembly 71 as next assembled with rails 5 alternately interleaved between slats 73*a-c* as shown such that holes 77*a-c* and 9*a-c* are collinearly aligned with binding screws 13 extending therethrough. The axial overlap between binding screws 13 and holes 77*a-c* and 9*a-c* serve to laterally align and interlock the slats 73*a-c* and rails 5. As the external threads of binding screws 13 are threadably tightened with the internal threads of their respective mating thread inserts 23, the axial stack of slats 73*a-c* and rails 5 are thereby brought together along the cross axis 15, with slats 73*a-c* nesting within adjoining notches 11*a-c* and rails 5 nesting within adjoining notches 75 as shown. Concurrently, the key surfaces 12 axially overlap their adjoining slats 73*a-c* and key surfaces 85 axially overlap their adjoining rails 5. Since key surfaces 12 are aligned to have a close fit with the upper surfaces 76*c* and lower surfaces 76*d* of slats 73*a-c* and key surfaces 85 are aligned to have a close fit with the left surfaces 19*c* and right surfaces 19*d* of rails 5, the axial overlaps therebetween serve to provide circumferential keyed engagement to prevent and/or limit rotation between adjoining slats 73*a-c* and rails 5 about cross axis 15. In contrast to the embodiment of FIGS. 1*a-i*, the embodiment of FIGS. 2*a-c* provides an additional redundant keyed engagement and interlock between the key surfaces 85 of the slats 73*a-c* and the mating rails 5 to prevent and/or restrict circumferential displacement and/or parallelogramming therebetween.

Next, the binding screws 13 are further threadably tightened and cinched with their respective thread inserts 23, which draws slats 73*a* and 73*c* axially toward each other to solidly clamp and sandwich the respective adjoining rails 5 and solidly nest the notches 75 within their corresponding mating notches 11*a-c* and axially abutting bottom surface 10 directly with their corresponding mating bottom surfaces 87.

The result is a solid axially abutting stack of rails 5 and slats 73*a-c* to minimize any flex or sag of the shelf assembly 1 and to withstand common shelving loads.

Both key surfaces 12 and 85 serve to provide a circumferential keyed engagement directly between mating slats 73*a-c* and rails 5 to prevent and/or limit circumferential movement, such as "parallelogramming" or racking, between adjoining slats 72*a-c* and rails 5 in a similar manner to that described in FIGS. 1*a-i*. Threadably cinching the binding screws 13 serves to solidly connect the slats 73*a-c* and rails 5 to each other and to limit and/or prevent movement therebetween. The resulting fully-assembled shelf assembly 51 may now be mounted to a structural element, such as a wall or floor, to support shelving loads in the conventional manner.

FIGS. 3*a-d* describes a shelf assembly 101 that is similar to the shelf assembly 1 of FIGS. 1*a-i*, except that notches 11*a-c* are omitted in favor of clip(s) 115 to provide a keying engagement to limit circumferential movement between slats 103*a-c* and rails 105 about cross axis 15. FIG. 3*a* is an exploded detail view of a simplified shelf assembly that includes only three slats 103*a-c* and two rails 105. It is understood that this shelf assembly 101 may be expanded to include multiple shelves and uprights similar to that shown in FIG. 1*c*. Slats 103*a-c* serve as generally horizontal members that make up the shelf 131 portions of the shelf assembly 101. Slat 103*a* serves as the furthest rearward horizontal member of shelf 131, having a through hole 107*a* and counterbore 125 aligned along cross axis 15. Slat 103*b* serves as the middle horizontal member of shelf 131, having a through hole 107*b* aligned along cross axis 15. Slat 103*c* serves as the furthest forward horizontal member of shelf 131, with a blind hole 107*c* aligned along cross axis 15. Hole 107*c* includes an internally threaded insert 123 fixed therein that threadably accept the external threads 114 of binding screw 113.

Rails 105 serve as generally vertical members that make up the upright 133 portions of the shelf assembly 101. Rail 105 includes through hole 109. Clip 115 has a flange portion 121 with hole 119 therethrough, two forward-extending tabs 117*a* and 117*b*, and two rearward-facing tabs 117*c* and 117*d*. Each tab 117*a-d* includes a corresponding key surface 120*a-d*, with key surfaces 120*a* and 120*b* orthogonal to key surfaces 120*c* and 120*d* as shown. Hole 119 is sized to provide a clearance fit with binding screw 113. As shown in FIG. 3*a*, clip 115 is positioned between slat 103*a* and the adjacent rail 105, with key surfaces 120*a* and 120*b* positioned to vertically straddle the upper surface 127*c* and lower surface 127*d* of slat 103*a* and with key surfaces 120*c* and 120*d* positioned to sideways straddle the left surface 128*c* and right surface 128*d* of the adjoining rail 105. Binding screw 113 is of conventional configuration, including external threads 114 and is schematically identical to binding screw 13.

FIG. 3*b* shows the shelf assembly 101 as next assembled in a manner similar to FIG. 1*c*, with rails 105 alternately interleaved between slats 103*a-c* as shown such that holes 107*a-c* and 109 are collinearly aligned and with binding screw 113 extending therethrough. Slats 103*a* and 103*c* serve to bookend the axial stack of clip 115, rails 105 and slats 103*a-c*. There are axial gaps 118 between adjacent rails 105 and slats 103*a-c* to create an open lattice shelf assembly 101 and provide ventilated shelves and uprights in a manner similar to that described in FIG. 1*g*. The axial overlap between binding screw 113 and holes 107*a-c* and 109 serve to laterally align the slats 103*a-c*, clip 115, and rails 105. As the external threads 114 of binding screw 113 are threadably tightened with the internal threads of internally threaded insert 123, the axial stack of slats 103*a-c* and rails 105 are thereby brought together along the cross axis 15, with slat 103*a* axially overlapping and nesting between key surfaces 120*a* and 120*b* as shown. Concurrently, the key surfaces 120*c* and 120*d* axially overlap the adjoining rail 105. Key surfaces 120*a* and 120*b* are aligned to have a close fit with the upper surface 127*c* and lower surface 127*d* of slat 103*a* and key surfaces 120*c* and 120*d* are aligned to have a close fit with the opposing left surface 128*c* and right surface 128*d* of adjoining rail 105. These axially overlapping and overlying orientations serve to provide a bi-directional circumferential keyed engagement and interlock therebetween to prevent and/or limit rotation between adjoining slat 103*a* and rail 105 in both circumferential directions 30. Since it is anticipated that FIGS. 3*a-d* describe a single cross axis in a lattice shelf arrangement similar to that of FIGS. 1*a-i* having multiple cross axes 15, the keyed engagement provided by the single clip 115 serves to maintain a perpendicular alignment between slats 3*a-c* and rails 5 and correspondingly between shelf 131 and upright 133. It is noted that clip 115 serves as an intermediate keying element, where the rail 105 has a circumferentially keyed engagement with the clip 115 in a first keying interface and the clip 115 has a circumferentially keyed engagement with the slat 103*a* in a second keying interface. Further, clip 115 serves as an intermediate abutting element, where the rail 105 axially abuts the clip 115 and the clip 115 axially abuts the slat 103*a*.

Openings 116 are similar to openings 47 of FIG. 1*d* in that they define the open spaces of the shelf assembly 101 between the uprights 133 and shelves 131. As shown in FIG. 3*d*, the clip 115 does not encroach on the openings 116 of the shelf assembly 101. This is advantageous because this leaves the shelf surfaces and upright surfaces of shelf assembly 101 free from any obstructions or sharp edges that may impede the placement of items (not shown) that the user may want to place on or in the shelf assembly 101.

Next, the binding screw 113 is further threadably cinched with its respective thread insert 123, which draws slats 103*a* and 103*c* axially toward each other and causes the slats 103*a* and 103*c* to sandwich and clamp the axial stack of rails 105, slat 103*b*, and clip 115. By sandwiching the clip 115 between the slat 103*a* and rail 105, the overlying engagements between key surfaces 120*a-d* and mating slat 103*a* and rail 105 is maintained by the binding screw 113 such that these components cannot be axially separated to defeat these overlie engagements. This serves to solidly connect the slats 3*a-c* and rails 105 to each other and to limit and/or prevent movement therebetween. The resulting fully-assembled shelf assembly 101 may now support shelving loads in the conventional manner.

It is understood that FIGS. 3*a-b* show only a detail of a single crossover point and that the shelf assembly 101 may be easily expanded to provide multiple shelves 131 and uprights 133 in a manner similar to the shelf assembly 1 shown in FIGS. 1*a-i*. While FIGS. 3*a-d* show only a single clip 115 utilized as an intermediate keying element between slat 103*a* and adjoining rail 105, it is obvious that multiple clips may be utilized and positioned in a similar manner to be sandwiched between slats 103*b-c* and adjoining rail(s) 105 to further fortify the circumferential engagements therebetween and further restrict any racking or "parallelogramming" of the shelf assembly 101. While the clip 115 may be made of any number of materials such as plastic, a preferred material is a metallic material such as steel.

FIGS. 4*a-d* describes a shelf assembly 151 that is similar to the shelf assembly 101 of FIGS. 3*a-d*, except that keying surfaces 120*a-d* are omitted in favor of pegs 167*a-d*. Holes 160 and 158*a-b* cooperate with clips 165 provide a keying engagement to limit and restrict circumferential rotation about cross axis 15 between slats 153*a-c* and rails 155. FIG. 4*a* is an exploded detail view of a simplified shelf assembly that includes only three slats 153*a-c* and two rails 155. Slats 153*a-c* serve as generally horizontal members that make up the shelf 181 portions of the shelf assembly 151. Slat 153*a* serves as the furthest rearward horizontal member of shelf 181, having a through hole 157*a* and counterbore 175 aligned along cross axis 15. Slat 153*b* serves as the middle horizontal member of shelf assembly 151, having a through hole 157*b* aligned along cross axis 15. Slat 153*c* serves as the furthest forward horizontal member of shelf assembly 151, with a blind hole 157*c* aligned along cross axis 15. Hole 157*c* includes an internally threaded insert 173 fixed therein that threadably accepts the external threads 164 of binding screw 163 in a manner similar to thread insert 23 of FIGS. 1*a-i*. Two through-hole recesses 158*a* extend axially through each of the slats 153*a* and 153*b* to laterally straddle holes 157*a-b* respectively. Two blind recesses 158*b* extend axially within each of slat 153*c* to laterally straddle hole 157*c*.

Rails 155 serve as generally vertical members that make up the upright 183 portions of the shelf assembly 151. Rails 155 each include through hole 159. Two through-hole recesses 160 extend axially through each of the rails 155 to laterally straddle respective holes 159. Clip 165 has a flange portion 171 with hole 169 therethrough and also includes two axially extending pegs 167*a* and 167*b* and two axially extending pegs 167*c* and 167*d* that are axially opposed to pegs 167*a* and 167*b*. Hole 169 is sized to provide a clearance fit with binding screw 163. As shown in FIG. 4*a*, clips 165 are positioned between slats 153*a-c* and the adjacent rails 155 as shown in FIG. 4*a*. Pegs 167*a* and 167*b* are aligned vertically to engage recesses 160 of the adjoining rails 155 and pegs 167*c* and 167*d* are aligned horizontally to engage recesses 158*a-b* of adjoining slats 153*a-c*. Binding screw 163 is of conventional configuration and schematically identical to binding screw 13.

FIG. 4*b* shows the shelf assembly 151 as next assembled in a manner similar to FIG. 1*c*, with rails 155 alternately interleaved between slats 153*a-c* as shown such that holes 157*a-c*, 159, and 169 are collinearly aligned, with binding screw 163 extending therethrough. The axial overlap between binding screw 163 and holes 157*a-c* and 159 serve to laterally align and provide an interlock between the slats 153*a-c* and rails 155. As the external threads of binding screw 163 is threadably tightened with thread insert 173, the axial stack of slats 153*a-c*, clips 165, and rails 155 are thereby brought together along the cross axis 15, with pegs 167*a* and 167*b* nested and axially overlying , overlapping, and engaged to adjoining recesses 160 and with pegs 167*c* and 167*d* axially overlying , overlapping, and engaged to adjoining recesses 158*a-b*. Since pegs 167*a-d* are aligned to have a close fit with their mating recesses 158*a-b* and 160, the axial overlap therebetween serves to provide a bi-directional circumferential keyed engagement and interlock therebetween to prevent and/or limit rotation between slats 153*a-c* and adjoining rails 155 in direction 30. This plurality of these keyed engagements provided by the plurality of clips 165 serves to multiply this keyed engagement to redundantly maintain a perpendicular alignment between slats 153*a-c* and rails 155 and correspondingly between shelf 181 and upright 183, thereby restricting racking or "parallelogramming" of the shelf assembly 151.

Next, the binding screw 163 is further threadably cinched with its respective thread insert 173, which draws slats 153*a* and 153*c* axially toward each other and causes the slats 153*a* and 153*c* to sandwich and clamp the axial stack of rails 155, slat 153*b*, and clips 165. This serves to solidly connect the slats 153*a-c* and rails 155 to each other and to limit and/or prevent axial movement therebetween. This also serves to maintain the circumferentially keyed engagement between pegs 167*a-d* and recesses 158*a-b* and 160. The resulting fully-assembled shelf assembly 151 may now support shelving loads in the conventional manner. It is understood that FIGS. 4*a-b* show only a detail of a single crossover point and associated cross axis 15. The shelf assembly 151 may be expanded to provide multiple shelves 181 and uprights 183 in a manner similar to the shelf assembly 1 shown in FIGS. 1*a-f*.

It is noted that recesses 158*a-b* and 160 are shown in FIGS. 4*a-b* to be pre-formed in their respective slats 153*a-c* and rails 155. It is envisioned that recesses 158*a-b* and 160 may alternatively be formed in-situ by pressing the pegs 167*a-d* into the mating surface of the slats 153*a-c* and/or rails 155. For example, the slats 153*a-c* and rails 155 may be made of wood and the clip may be of a harder material such as steel. Sharp nail-points may be substituted for pegs 167*a-d* such that, when binding screw 163 is threadably tigthened, it causes these nail-points to impale and penetrate the mating wood surfaces of the slats 153*a-c* and/or rails 155, thereby creating recesses 158*a-b* and 160 in-situ and also providing the aforementioned keyed engagement therebetween.

FIGS. 5*a-c* describes an embodiment similar in arrangement to FIG. 1*k* where the binding screws 207 extend axially through (or within) the slats 203*a-b* at a location outside of (and external to) the crossover region. Slat 203*a* includes clearance holes 219 therethrough with respective counterbores 220 to receive the respective binding screws 207 in the conventional manner. Slat 203*a* also includes notch 209*a* with key surfaces 221 and bottom surface 208*a*. The bottom surface 208*a* includes a hole 210*a* therein to receive the pin 213*a* as shown in FIG. 5*c*. Slat 203*b* includes thread inserts 211, each with internal threads 212 therein to threadably receive the external threads 214 of respective binding screws 207 in the conventional manner. Slat 203*b* also includes notch 209*b* with key surfaces 221 and bottom surface 208*b*. The bottom surface 208*b* includes a hole 210*b* therein to receive the pin 213*b*. Pins 213*a* and 213*b* are identical and of conventional cylindrical configuration. Rail 205 includes axially opposed notches 218*a* and 218*b* having a width 217 between vertically opposed keying surfaces 222 that corresponds to the diameter of mating pins 213*a* and 213*b* as shown in FIG. 5*c*.

To assemble the shelf assembly 201 as shown in FIGS. 5*b* and 5*c*, pins 213*a* and 213*b* are each inserted in their respective holes 210*a* and 210*b*, leaving a portion of each to protrude from the respective bottom surfaces of notches 209*a* and 209*b*. Slats 203*a* and 203*b* are next assembled in respective directions 202*a* and 202*b* to axially sandwich rail 205, with the rail 205 nested within notches 209*a* and 209*b* such that the protruding portions of pins 213*a* and 213*b* are nested within notches 218*a* and 218*b* respectively to provide an axially overlying engagement with keying surfaces 222. Binding screws are next inserted through holes 219 and external threads 214 are threadably assembled with internal threads 212.

As the external threads 214 are threadably tightened with the internal threads 212, slats 203*a* and 203*b* are thereby brought together along the cross axis 15, with the bottom surfaces 208*a* and 208*b* axially abutting the rail 205 and with rail 205 also nesting within adjoining notches 218*a* and 218*b* as shown. Concurrently, the key surfaces 221 axially overlap the rail 205 to provide a circumferential keyed engagement and interlock therebetween to prevent and/or limit circumferential rotation between slats 203*a-b* and their mating rail 205 about the cross axis 15. Further, the pins 213*a* and 213*b* span to engage both the notches 218*a* and 218*b* and holes 210*a* and 210*b*, serving as interlocking keys to limit displacement therebetween in directions 29*a* and 29*b*. As such, pins 213*a* and 213*b* may be considered as intermediate keying elements where the hole 210*a* of slat 203*a* is vertically keyed to pin 213*a* and pin 213*a* is vertically keyed to the notch 218*a* of rail 205, where the pin 213*b* provides an identical engagement between rail 205 and slat 203*b*.

The binding screws 207 are further threadably tightened and cinched with their respective thread inserts 211, which draws slats 203*a* and 203*b* to solidly clamp and sandwich the respective adjoining rail 205. The result is a solidly abutting axial stack of slats 203*a-b* and rail 205 to minimize any flex or sag of the shelf assembly 201 and to withstand common shelving loads. The contact pressure therebetween serves to maintain the square and orthogonal alignment of the slats 203*a-b* relative to rail 205 and provides further resistance to any tilting displacement 16 of the slats 203*a-b* due to shelf load and/or the weight of the shelf assembly 201 itself.

The interlocking keyed engagement between notches 209*a* and 209*b* and rail 205 prevents and/or restricts independent movement between the slats 203*a* and 203*b* and the rail 205 in directions 28*a* and 28*b* as well as the circumferential direction 30. The keyed engagement between notches 218*a* and 218*b* and respective holes 210*a* and 210*b* prevents and/or restricts independent movement between the slats 203*a* and 203*b* and the rail 205 in directions 29*a* and 29*b*. The binding screws 207 prevent and/or restrict independent movement between the slats 203*a* and 203*b* and the rail 205 in directions 27*a* and 27*b* as well as the tilting direction 16. These engagements serve to limit "parallelogramming" or racking (i.e. non-aligned distortion) of the shelf assembly 201, thus maintaining the alignment of the shelf assembly 201, preferably without necessitating any additional web or diagonal bracing as is common with conventional shelf assemblies.

Pins 213*a* and 213*b*, notches 218*a* and 218*b*, and holes 210*a* and 210*b* may alternatively be omitted. In such a case, the clamping friction (provided by binding screws 207) between the bottom surfaces 208*a* and 208*b* and their adjoining and abutting surfaces of rail 205 may be sufficient to prevent and/or resist independent movement between the slats 203*a* and 203*b* and the rail 205 in directions 29*a* and 29*b*.

In an alternate configuration only a single pin 213*a* or 213*b* could be utilized with satisfactory results. For example pin 213*a*, notch 218*a*, and hole 210*a* may be omitted. In such a case, pin 213*b* would provide a keying engagement between rail 205 and slat 203*b* to resist independent movement therebetween in directions 29*a* and 29*b*. However, binding screws 207, which bridge between slats 203*a* and 203*b*, would serve as intermediate keying elements between slats 203*a* and 203*b* to resist independent movement therebetween in directions 29*a* and 29*b*.

In an alternate configuration, the shelf assembly 101 may alternatively be rotated 90 degrees about the cross axis 15. In such a case, the slats 203*a* and 203*b* become vertical members and the rail becomes a horizontal member. In this case, the binding elements (i.e. screws 207) are outside of (or external to) the crossover region and within the vertical member. In a further alternative arrangement, a first binding element (i.e. screw 207) may extend outside of (or external to) the crossover region and within the vertical member and a second binding may element extend outside of (or external to) the crossover region and within the horizontal member.

While my above description contains many specificities, these should not be construed as limitations on the scope of the invention, but as merely providing exemplary illustrations of some of the preferred embodiments of this invention. For example:

It is noted that the slats and rails described in the figures are shown to be generally linear and straight elements. This general configuration is provided herein to aid in the simplicity of explanation of the present invention. However, it is envisioned that any of these slats and/or rails may alternatively include curve(s), jog(s), step(s) or any other type of non-linear or non-straight geometry.

The embodiments herein describe numerous types of keyed engagements, including pegs/pins, holes, notches, tabs, among others. It is understood that these are provided to show a series of representative means to provide a keyed engagement between a given slat and a given rail. It is understood that a wide range of alternate keyed engagements known in industry may be substituted. As one example, a slat may include an axially extending peg of square (or non-round) profile and an adjoining rail may include an axially extending recess having a mating square (or non-round) profile such that, upon assembly, the axial overlap between peg and recess are circumferentially keyed to each other to transmit torque and thereby restrict rotation therebetween about the cross axis.

The axially interleaved stack of horizontal members (i.e. slats) and vertical members (i.e. rails) are shown in these embodiments to be bookended by two horizontal members. Alternatively, the axially interleaved stack may be bookended by two vertical members. As a further alternative, the axially interleaved stack may be bookended by one horizontal member and one vertical member.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications that are within its spirit and scope as defined by the claims.

The invention claimed is:

1. A shelf assembly system including:

a plurality of horizontal members, including a first horizontal member and a second horizontal member, each respectively extending along a horizontal member axis and including an axially forward surface, an axially rearward surface, an upper surface, and a lower surface;

a vertical member extending along a vertical member axis and arranged to cross said first horizontal member and said second horizontal member as viewed in a plan view, including a front surface, a rear surface, a left surface, a right surface;

a cross axis extending in an axial direction that is generally perpendicular to both said horizontal member axis and said vertical member axis;

a binding element to bind said first and second horizontal members to said vertical member in said axial direction;

wherein:

said vertical member is axially positioned between said first horizontal member and said second horizontal member;

said first and second horizontal members are arranged to cross said vertical member at respective crossover interfaces wherein at least one of: (i) said forward surface is axially adjacent to said rear surface; and (ii) said rearward surface is axially adjacent to said front surface;

said first horizontal member is keyed to said vertical member at a keying interface adjacent said crossover interface to circumferentially lock said horizontal member to said vertical member about said cross axis;

said cross axis extends through said crossover interface;

said upper surface of said first horizontal member and said upper surface of said second horizontal member are aligned to provide a generally planar shelf surface;

said binding element serves to axially bind and press said at least one of first and second horizontal members toward said vertical member and to maintain said keying interface;

wherein at least one of: (i) said first horizontal member includes a notch in at least one of said forward surface and said rearward surface, said notch includes a recessed surface that is recessed from the associated one of said forward surface and said rearward surface, said notch is mated to said vertical member with said recessed surface serving as an axially limit stop abutting said vertical member; and (ii) said first vertical member includes a notch in at least one of said front surface and said rear surface, said notch includes a recessed surface that is recessed from the associated one of said front surface and said rear surface, said notch is mated to said first horizontal member with said recessed surface serving as an axial limit stop abutting said first horizontal member;

wherein said notch includes a keying surface to provide said keying interface; and wherein said binding element serves to axially press said recess surface against the mating one of said vertical member and said first horizontal member.

2. The shelf assembly system according to claim 1, wherein said first horizontal member includes a first notch of said notches, having a first of said recess surfaces and said second horizontal member includes a second of said notches having a second of said recess surfaces axially opposed and facing said first recess surface, wherein said first recess surface is axially abutting said front surface of said vertical member and said second recess surface is axially abutting said rear surface of said vertical member, including a first of said keying interfaces between said first notch and said vertical member and a second of said keying interfaces between said second notch and said vertical member.

3. The shelf assembly system according to claim 1, wherein said notch of said first horizontal member includes two keying surfaces that are generally opposed to each other along said horizontal member axis and wherein said keying surfaces serve to provide said keying interface with said vertical member.

4. The shelf assembly system according to claim 1, wherein both: (i) said first horizontal member includes a first notch and said keying interface is in said first notch; and (ii) said vertical member includes a second notch and said keying interface is in said second notch.

5. The shelf assembly system according to claim 1, wherein said keying interface is between at least one of: (i) said notch of said first horizontal member and at least one of said left surface and said right surface of said vertical member; and (ii) said notch of said vertical member and at least one of said top surface and said bottom surface of said first horizontal member.

6. The shelf assembly system according to claim 1, wherein at least one of said first and second horizontal members includes an axially extending first opening therethrough and said vertical element includes an axially extending second opening therethrough collinear with said first opening, and wherein said binding element extends within said first opening and said second opening, and wherein said binding element extends within said crossover interface to span between said at least one of said first and second horizontal members and said vertical member.

7. The shelf assembly system according to claim 1, wherein said binding element extends laterally outboard outside of said crossover interface and through one of said first horizontal member and said vertical member.

8. The shelf assembly system according to claim 1, wherein said binding element extends outside of said crossover interface and laterally outboard of said at least one of: (i) said first and second horizontal members and (ii) said vertical member.

9. The shelf assembly system according to claim 1, wherein said binding element includes a threadable engagement extending along an axial axis that serves to restrict axial separation between at least one of said first and second horizontal members and said vertical member and to maintain said keying interface.

10. The shelf assembly system according to claim 1, wherein said keying interface includes an axially overlapping overlie engagement directly between at of said first horizontal member and said vertical member.

11. The shelf assembly system according to claim 1, wherein said keying interface is a blocking keyed interface.

12. The shelf assembly system according to claim 1, wherein said recessed surface is includes an inclined surface that is non-parallel and non-orthogonal relative to said cross axis such that said keying interface is a non-blocking keyed interface, wherein said axial press serves to press said inclined surface against the mating one of said vertical member and said first horizontal member.

13. The shelf assembly system according to claim 1, wherein at least one of: (i) said vertical member is axially sandwiched between said first and second horizontal members; and (ii) said at least one of said first and second horizontal members is axially sandwiched between a plurality of said vertical members.

14. The shelf assembly system according to claim 1, including a plurality of said vertical members arranged to provide an axially alternating interleaved and stacked lattice of said plurality of said horizontal members and said plurality of said vertical members, wherein said axially interleaved and stacked lattice is axially bookended by at least one of said plurality of said horizontal members, wherein at least one of said horizontal members is axially positioned between said plurality of vertical members, wherein the bookending one of said plurality of said horizontal members provides an increased surface area of said planar shelf surface in comparison to the surface area of said planar shelf surface without said bookending one of said plurality of said horizontal members.

15. The shelf assembly system according to claim 14, wherein said binding element is axially anchored to the bookending one of said plurality of said horizontal members at an anchor location axially overlapping the bookending horizontal member.

16. The shelf assembly system according to claim 14 wherein said axially interleaved and stacked lattice is axially bookended between two of said plurality of horizontal members, and wherein said binding element is anchored to a first of said bookending one of said plurality of said horizontal members and opposedly anchored to a second of said bookending one of said plurality of said horizontal members.

17. The shelf assembly system according to claim 1, wherein said keying interface serves to limit displacement of said first horizontal member relative to said vertical element along said horizontal member axis.

18. The shelf assembly system according to claim 1, wherein said first horizontal member extends along said horizontal member axis leftwardly beyond said left surface and rightwardly beyond said right surface and said vertical member extends upwardly beyond said upper surface and downwardly beyond said lower surface.

19. The shelf assembly system according to claim 1, wherein said vertical member has a width between said left and right surfaces and said first horizontal member has a thickness between said upper surface and said lower surface, and wherein at least one of: (i) said first horizontal member includes a pair of sideways spaced keying surfaces for said keying interface and said sideways space is has an interference fit with said width; and (ii) said vertical member includes a pair of vertically spaced keying surfaces for said keying interface and said vertical space is has an interference fit with said thickness.

20. The shelf assembly system according to claim 1, wherein said binding element serves to bind only a singular one of said plurality of said horizontal members to a singular adjacent one of said vertical member wherein both: (i) said first horizontal member includes a notch and said keying interface is in said notch, and (ii) said vertical member includes a notch and said keying interface is in said notch; and wherein said keying interface is between: (i) said notch of said first horizontal member and both said left surface and said right surface of said vertical member, and (ii) said notch of said vertical member and both said top surface and said bottom surface of said first horizontal member.

21. The shelf assembly system according to claim 1, wherein said binding element is a threadable binding element to include a threadable engagement to provide said binding, wherein said threadable engagement extends along an axial axis and serves to axially press said recess surface against said mated one of said vertical member and said first horizontal member.

22. The shelf assembly system according to claim 21, wherein at least one of said first and second horizontal members and said vertical member includes an internally threaded insert axially and circumferentially fixed thereto, said threaded insert provides said threadable engagement with said binding element.

23. The shelf assembly system according to claim 21, wherein said binding element includes external threads and said threadable engagement is a blind threadable engagement between said external threads and a blind hole of one of: (i) one of said plurality of horizontal members and (ii) said vertical member.

24. The shelf assembly system according to claim 1, wherein at least one of: (i) said first horizontal member is axially separated from said second horizontal member, including an axial gap therebetween; and (ii) including a first vertical member and second vertical member axially straddling one of said plurality of horizontal members such that said first vertical member is axially separated from said second vertical member, including an axial gap therebetween.

25. The shelf assembly system according to claim 1, wherein said first horizontal member includes a first notch having a first recess surface; and (ii) said vertical member includes a second notch having a second recess surface, wherein said binding element serves to axially press said first recess surface against said second recess surface.

26. The shelf assembly system according to claim 1, including an axially alternating interleaved and stacked lattice of said plurality of said horizontal members and said vertical member, wherein said axially interleaved and stacked lattice is axially bookended by: (i) a first bookending member comprising one of said plurality of said horizontal members; and (ii) a second bookending member; said second bookending member comprising one of: (i) said vertical member; or (ii) another of said plurality of said horizontal members; wherein said binding element is axially braced solely between a first anchoring connection at said first bookending member and a second anchoring connection at said second bookending member.

27. The shelf assembly system according to claim 1, including a plurality of said vertical members arranged to provide an axially alternating interleaved and stacked lattice of said plurality of said horizontal members and said plurality of said vertical members extending along said cross axis, including a first of said keying interfaces between said a first of said plurality of horizontal members and a first of said plurality of vertical members and a second of said keying interfaces between said a second of said plurality of horizontal members and a second of said plurality of vertical members, wherein said first keying interface and said second keying interface are axially aligned along a common cross axis.

28. A shelf assembly system including:

a plurality of horizontal members, including a first horizontal member and a second horizontal member, each respectively extending along a horizontal member axis and including an axially forward surface, an axially rearward surface, an upper surface, and a lower surface;

a vertical member extending along a vertical member axis and arranged to cross said first horizontal member and said second horizontal member as viewed in a plan view, including a front surface, a rear surface, a left surface, a right surface;

a cross axis extending in an axial direction that is generally perpendicular to both said horizontal member axis and said vertical member axis;

a binding element to bind said first horizontal member to said vertical member in said axial direction;

wherein said vertical member is axially positioned between said first horizontal member and said second horizontal member;

wherein said first and second horizontal members are arranged to cross said vertical member at respective crossover interfaces wherein at least one of: (i) said forward surface is axially adjacent to said rear surface; and (ii) said rearward surface is axially adjacent to said front surface;

wherein at least one of said first and second horizontal members is keyed to said vertical member at a keying interface adjacent said crossover interface to circumferentially lock said horizontal member to said vertical member about said cross axis;

wherein said cross axis extends through said crossover interface;

wherein said upper surface of said first horizontal member and said upper surface of said second horizontal member are aligned to provide a generally planar surface;

wherein said binding element serves to axially bind and press said at least one of said first and second horizontal members toward said vertical member and to maintain said keying interface;

including an intermediate element axially positioned between said first horizontal member and said vertical member, wherein said keying interface is between said first horizontal member and said intermediate element and between said intermediate element and said vertical member;

wherein said keying interface is between at least one of: (i) said intermediate element and at least one of said left surface and said right surface of said vertical member; and (ii) said intermediate element and at least one of said top surface and said bottom surface of said first horizontal member; and wherein said intermediate element is fully obscured by at least one of said first horizontal member, said second horizontal member, and said vertical member as viewed in the plan view.

29. The shelf assembly system according to claim 28, wherein said intermediate element is axially sandwiched between said first horizontal member and said vertical member.

* * * * *